US009829811B2

(12) United States Patent
Azuma et al.

(10) Patent No.: US 9,829,811 B2
(45) Date of Patent: Nov. 28, 2017

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Jun Azuma, Osaka (JP); Takahiro Oki, Osaka (JP); Keiji Maruo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/195,319

(22) Filed: Jun. 28, 2016

(65) Prior Publication Data

US 2017/0003608 A1 Jan. 5, 2017

(30) Foreign Application Priority Data

Jun. 30, 2015 (JP) ..... 2015-131182

(51) Int. Cl.
*G03G 5/047* (2006.01)
*G03G 5/06* (2006.01)
(Continued)

(52) U.S. Cl.
CPC ..... *G03G 5/0614* (2013.01); *G03G 5/056* (2013.01); *G03G 5/0564* (2013.01);
(Continued)

(58) Field of Classification Search
CPC ..... G03G 5/047
See application file for complete search history.

(56) References Cited

U.S. PATENT DOCUMENTS 8,519,082 B2 8/2013 Hikosaka et al.
2002/0098428 A1* 7/2002 Watanabe ..... G03G 5/0567 430/56

(Continued)

FOREIGN PATENT DOCUMENTS

JP 2011-026574 A 2/2011
JP 2015087500 * 5/2015 ..... G03G 5/06

OTHER PUBLICATIONS

Machine English language translation of JP 2015087500, May 7, 2015.*

*Primary Examiner* — Hoa V Le
(74) *Attorney, Agent, or Firm* — Studebaker & Brackett PC

(57) ABSTRACT

An electrophotographic photosensitive member includes a conductive substrate and a photosensitive layer. The photosensitive layer contains at least a charge generating material, a hole transport material, and a binder resin. The hole transport material is a compound represented by the following general formula (1). The binder resin is a resin represented by the following general formula (2). In general formula (1), $R_1$ and $R_3$ each independently represent an alkyl group, an aryl group, an aralkyl group, or an alkoxy group; and $R_2$ and $R_4$ each independently represent an alkyl group, or an alkoxy group. In general formula (2), $R_{23}$, $R_{24}$, and $R_{25}$ each independently represent a hydrogen atom, or a $C_{1-4}$ alkyl group, at least one of $R_{23}$, $R_{24}$, and $R_{25}$ representing a $C_{1-4}$ alkyl group; $p+q=1.00$, and $0.35 \leq p < 1.00$; and n represents 2 or 3.

(Continued)

(1)

(2)

9 Claims, 3 Drawing Sheets

(51) Int. Cl.
*G03G 5/05* (2006.01)
*G03G 15/00* (2006.01)

(52) U.S. Cl.
CPC ..... *G03G 5/0672* (2013.01); *G03G 5/0675* (2013.01); *G03G 5/0696* (2013.01); *G03G 15/75* (2013.01)

(56) References Cited

U.S. PATENT DOCUMENTS

2012/0100474 A1 4/2012 Hikosaka et al.
2014/0120464 A1* 5/2014 Iwashita ..... G03G 15/75 430/56

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. §119 to Japanese Patent Application No. 2015-131182, filed on Jun. 30, 2015. The contents of this application are incorporated herein by reference in their entirety.

BACKGROUND

The present disclosure relates to an electrophotographic photosensitive member, a process cartridge, and an image forming apparatus.

An electrophotographic photosensitive member is used in an electrophotographic image forming apparatus. The electrophotographic photosensitive member includes a photosensitive layer. The photosensitive layer contains, for example, a charge generating material, a charge transport material (such as a hole transport material), and a resin binding these materials (i.e., a binder resin). The electrophotographic photosensitive member can be, for example, a multi-layer electrophotographic photosensitive member or a single-layer electrophotographic photosensitive member. The multi-layer electrophotographic photosensitive member includes, as the photosensitive layer, a charge generating layer having a charge generating function, and a charge transport layer having a charge transporting function. The single-layer electrophotographic photosensitive member includes, as the photosensitive layer, a single-layer type photosensitive layer having charge generating and charge transporting functions.

In one aspect of the electrophotographic photosensitive member, a photosensitive layer is provided on a conductive base plate (an example of a conductive substrate). The photosensitive layer contains a polycarbonate copolymer as a component.

SUMMARY

An electrophotographic photosensitive member of the present disclosure includes a conductive substrate, and a photosensitive layer. The photosensitive layer contains at least a charge generating material, a hole transport material, and a binder resin. The hole transport material is a compound represented by the following general formula (I). The binder resin is a resin represented by the following general formula (2).

(1)

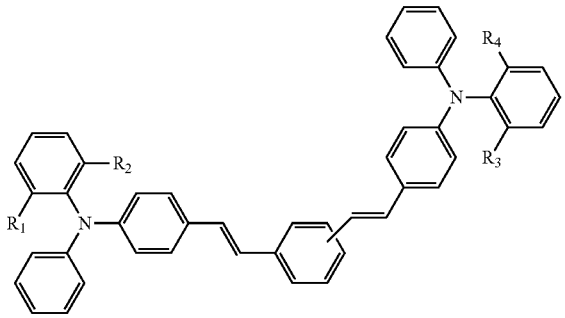

In general formula (1), $R_1$ and $R_3$ each independently represent an alkyl group, an aryl group, an aralkyl group, or an alkoxy group; and $R_2$ and $R_4$ each independently represent an alkyl group, or an alkoxy group.

(2)

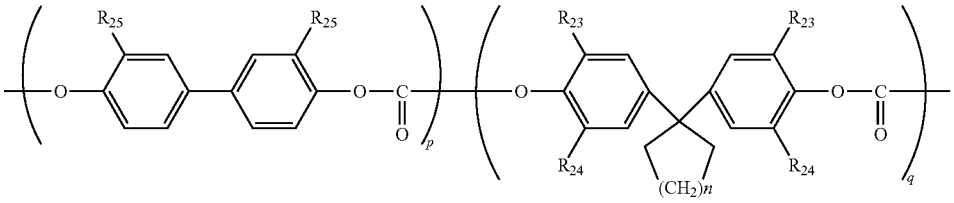

In general formula (2), $R_{23}$, $R_{24}$, and $R_{25}$ each independently represent a hydrogen atom, or an alkyl group having a carbon number of at least 1 and no greater than 4, at least one of $R_{23}$, $R_{24}$, and $R_{25}$ representing an alkyl group having a carbon number of at least 1 and no greater than 4; $p+q=1.00$, and $0.35 \leq p < 1.00$; and n represents 2 or 3.

A process cartridge of the present disclosure includes the above-described electrophotographic photosensitive member.

An image forming apparatus of the present disclosure includes an image bearing member, a charging section, a light exposure section, a developing section, and a transfer section. The charging section charges a surface of the image bearing member. The light exposure section forms an electrostatic latent image on the surface of the image bearing member. The developing section develops the electrostatic latent image into a toner image. The transfer section transfers the toner image from the image bearing member to a transfer target. The image bearing member is the electrophotographic photosensitive member described above.

DETAILED DESCRIPTION

Figure 1A:
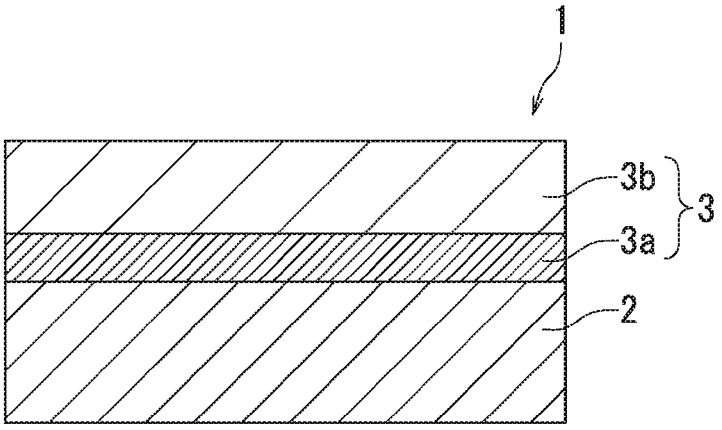
FIGS. 1A, 1B, and 1C are partial cross-sectional views of examples of an electrophotographic photosensitive member according to a first embodiment of the present disclosure.

Preferred embodiments of the present disclosure will now be described in detail. It is noted that the present disclosure is not limited to the following embodiments but appropriate modifications and changes can be made within the scope of the object of the present disclosure. Incidentally, description is appropriately omitted in some cases where the description is redundant, which does not limit the gist of the present disclosure.

It is noted that the term "-based" following the name of a compound is used in some cases for comprehensively referring to the compound and derivatives thereof. Besides, if the term "-based" following the name of a compound is used for referring to a polymer, it means that a repeating unit of the polymer is derived from the compound or a derivative thereof.

First Embodiment: Electrophotographic Photosensitive Member

A first embodiment relates to an electrophotographic photosensitive member (hereinafter sometimes referred to as the "photosensitive member") 1. The photosensitive member 1 will now be described with reference to FIGS. 1A to 1C and FIGS. 2A to 2C. The photosensitive member 1 may be a multi-layer photosensitive member or a single-layer photosensitive member. The photosensitive member 1 includes a photosensitive layer 3. The photosensitive layer 3 contains at least a charge generating material, a hole transport material, and a binder resin. The hole transport material is a compound represented by general formula (1) (hereinafter sometimes referred to as the "compound (1)"). The binder resin is a resin represented by general formula (2) (hereinafter sometimes referred to as the "resin (2)").

The photosensitive member 1 is excellent in abrasion resistance. This is probably for the following reason: The compound (1) contained in the photosensitive layer 3 has two diphenylamino groups. Two phenyl groups included in each of the diphenylamino groups have asymmetric structures. More specifically, one of the phenyl groups of each diphenylamino group has no substituent, but the other phenyl group has a substituent ($R_1$, $R_2$, $R_3$, or $R_4$) in the ortho-position. The resin (2) contained in the photosensitive layer 3 has at least one alkyl group having a carbon number of at least 1 and no greater than 4.

The compound (1) and the resin (2) having such structures tend to be excellent in solubility in a solvent used for forming the photosensitive layer 3. Besides, the compound (1) and the resin (2) having such structures tend to be excellent in compatibility. Therefore, since the photosensitive layer 3 contains the compound (1) and the resin (2), an application liquid for the photosensitive layer 3 in which the compound (1) and the resin (2) are homogeneously dispersed can be prepared, and hence, the compound (1) is presumed to be homogeneously dispersed in the resultant photosensitive layer 3. Besides, the resin (2) having such a structure is presumed to readily form a stacking structure in the photosensitive layer 3. As a result, the photosensitive layer 3 is improved in the layer density, which probably improves the strength of the photosensitive layer 3. Accordingly, the photosensitive member 1 is excellent in the abrasion resistance.

<1. Multi-Layer Photosensitive Member>

Figure 1B:
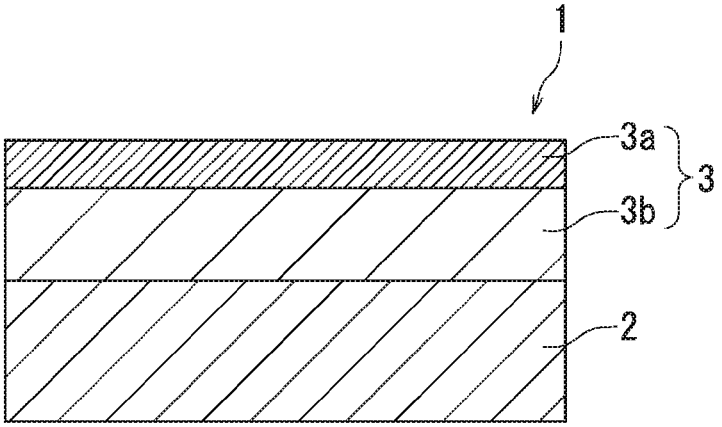
Figure 1C:
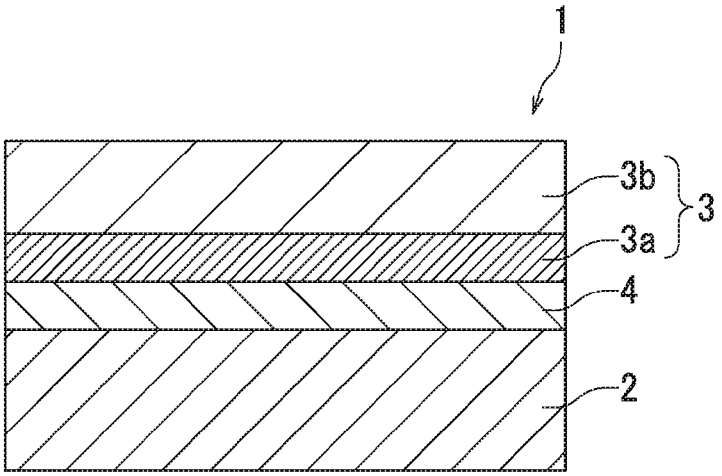

Referring to FIGS. 1A to 1C, a case where the photosensitive member 1 is a multi-layer photosensitive member will now be described. FIGS. 1A to 1C are partial cross-sectional views of exemplified structures of the multi-layer photosensitive member described as one aspect of the photosensitive member 1 of the present embodiment.

As illustrated in FIG. 1A, the multi-layer photosensitive member corresponding to the photosensitive member 1 includes a conductive substrate 2, and a photosensitive layer 3. The multi-layer photosensitive member corresponding to the photosensitive member 1 includes, as the photosensitive layer 3, a charge generating layer 3*a* and a charge transport layer 3*b*.

As illustrated in FIG. 1A, the photosensitive layer 3 may be directly provided on the conductive substrate 2. Alternatively, as illustrated in FIG. 1C, an intermediate layer (an undercoat layer) 4 may be provided between the conductive substrate 2 and the photosensitive layer 3. Alternatively, a protective layer 5 (not illustrated) may be provided on the photosensitive layer 3.

As illustrated in FIG. 1B, in the multi-layer photosensitive member corresponding to the photosensitive member 1, the charge transport layer 3*b* may be provided on the conductive substrate 2, with the charge generating layer 3*a* provided on the charge transport layer 3*b*. Since the charge transport layer 3*b* generally has a larger thickness than the charge generating layer 3*a*, therefore, the charge transport layer 3*b* is more difficult to be damaged than the charge generating layer 3*a*. Therefore, in order to improve the abrasion resistance of the multi-layer photosensitive member corresponding to the photosensitive member 1, the charge transport layer 3*b* is preferably provided on the charge generating layer 3*a* as illustrated in FIG. 1A.

The thicknesses of the charge generating layer 3*a* and the charge transport layer 3*b* are not especially limited as long as these layers can sufficient exhibit their own functions. The thickness of the charge generating layer 3*a* is preferably 0.01 μm or more and 5 μm or less, and more preferably 0.1 μm or more and 3 μm or less. The thickness of the charge transport layer 3*b* is preferably 2 μm or more and 100 μm or less, and more preferably 5 μm or more and 50 μm or less.

The charge generating layer 3*a* of the photosensitive layer 3 contains a charge generating material. The charge generating layer 3*a* may further contain, if necessary, a binder resin for the charge generating layer 3*a* (hereinafter sometimes referred to as the "base resin"), an n-type pigment, and various additives. The charge generating material, the base resin, the n-type pigment and the additives will be described later.

The charge transport layer 3*b* of the photosensitive layer 3 contains a hole transport material and a binder resin. The charge transport layer 3*b* may further contain, if necessary, an electron acceptor compound, and various additives. The hole transport material, the binder resin, the electron acceptor compound, and the additives will be described later. In order to improve the abrasion resistance of the photosensitive member 1, the charge transport layer 3*b* containing the hole transport material of the compound (1), and the binder resin of the resin (2) is preferably an outermost layer of the photosensitive member 1.

<2. Single-Layer Photosensitive Member>

Figure 2A:
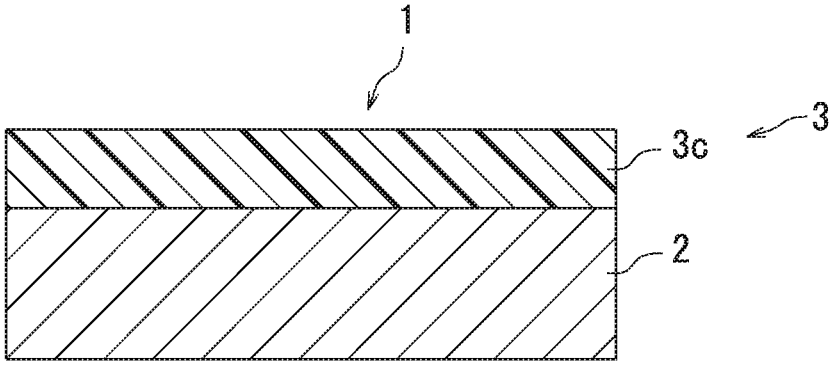
FIGS. 2A, 2B, and 2C are partial cross-sectional views of other examples of the electrophotographic photosensitive member according to the first embodiment of the present disclosure.
Figure 2B:
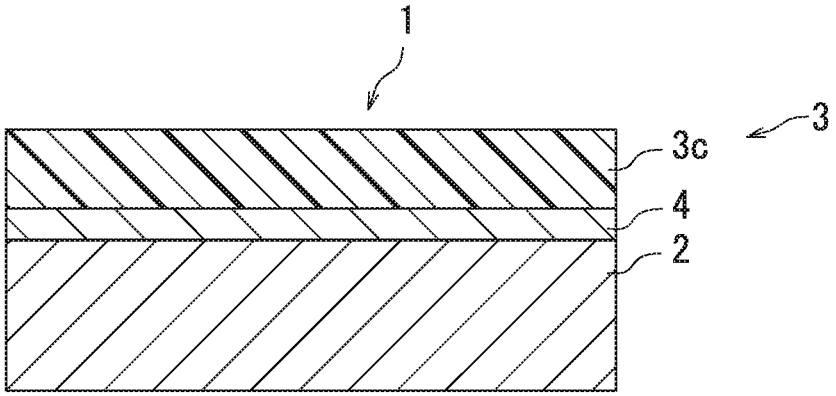
Figure 2C:
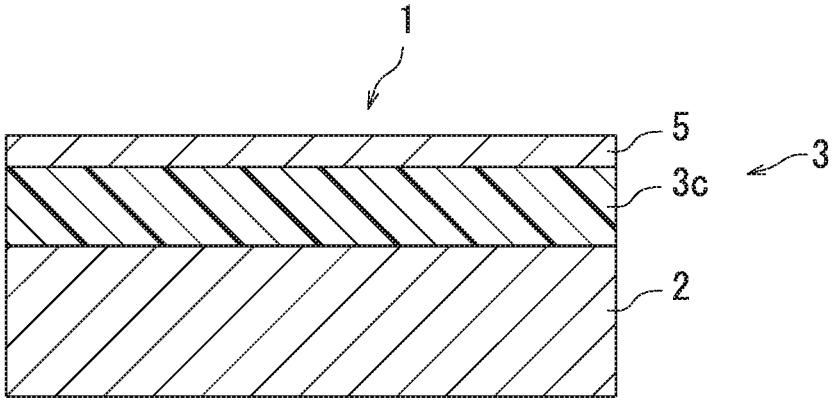

Referring to FIGS. 2A to 2C, a case where the photosensitive member 1 is a single-layer photosensitive member will now be described. FIGS. 2A to 2C are partial cross-sectional views of exemplified structures of the single-layer photosensitive member described as another aspect of the photosensitive member 1 of the present embodiment.

As illustrated in FIG. 2A, the single-layer photosensitive member corresponding to the photosensitive member 1 includes a conductive substrate 2, and a photosensitive layer 3. The single-layer photosensitive member corresponding to the photosensitive member 1 includes, as the photosensitive layer 3, a single-layer type photosensitive layer 3*c* (a single photosensitive layer, i.e., a photosensitive layer that is a single layer). As illustrated in FIG. 2A, the single-layer type photosensitive layer 3*c* may be directly provided on the conductive substrate 2.

Alternatively, as illustrated in FIG. 2B, the single-layer photosensitive member corresponding to the photosensitive member 1 may include a conductive substrate 2, a single-layer type photosensitive layer 3*c*, and an intermediate layer 4. The intermediate layer (the undercoat layer) 4 is provided, for example, between the conductive substrate 2 and the single-layer type photosensitive layer 3*c*. Alternatively, as illustrated in FIG. 2C, a protective layer 5 may be provided on the single-layer type photosensitive layer 3*c*.

The thickness of the single-layer type photosensitive layer 3*c* is not especially limited as long as the single-layer type photosensitive layer can sufficiently exhibit its own function. The thickness of the single-layer type photosensitive layer 3*c* is preferably 5 μm or more and 100 μm or less, and more preferably 10 μm or more and 50 μm or less.

The single-layer type photosensitive layer 3*c* corresponding to the photosensitive layer 3 contains a charge generating material, a hole transport material, and a binder resin. The single-layer type photosensitive layer 3*c* may further contain, if necessary, an electron transport material, an n-type pigment, and various additives. The charge generating material, the hole transport material, the binder resin, the electron transport material, the n-type pigment, and the additives will be described later. In order to improve the abrasion resistance of the photosensitive member 1, the single-layer type photosensitive layer 3*c* containing the hole transport material of the compound (1), and the binder resin of the resin (2) is preferably an outermost layer of the photosensitive member 1.

What has been described so far is the structures of the multi-layer photosensitive member and the single-layer photosensitive member corresponding to the photosensitive member 1. Next, the elements commonly used in the multi-layer photosensitive member and the single-layer photosensitive member corresponding to the photosensitive member 1 will be described.

<3. Conductive Substrate>

The conductive substrate 2 is not especially limited as long as it can be used as a conductive substrate for the photosensitive member 1. The conductive substrate 2 has at least a surface portion thereof made of a conductive material. An example of the conductive substrate 2 includes a conductive substrate made of a conductive material. Another example of the conductive substrate 2 includes a conductive substrate coated with a conductive material. Examples of the conductive material include aluminum, iron, copper, tin, platinum, silver, vanadium, molybdenum, chromium, cadmium, titanium, nickel, palladium, indium, stainless steel, and brass. One of these conductive materials may be singly used, or two or more of these may be used in combination (in the form of, for example, an alloy). Among these conductive materials, aluminum or an aluminum alloy is preferably used because charge is thus excellently transferred from the photosensitive layer 3 to the conductive substrate 2.

The shape of the conductive substrate 2 can be appropriately selected in accordance with the structure of an image forming apparatus 6 (see FIG. 3) described later in a second embodiment. The conductive substrate 2 can be, for example, in the shape of a sheet or a drum. Besides, the thickness of the conductive substrate 2 can be appropriately selected in accordance with the shape of the conductive substrate 2.

<4. Charge Generating Material>

If the photosensitive member 1 is a multi-layer photosensitive member, the charge generating layer 3*a* contains the charge generating material. If the photosensitive member 1 is a single-layer photosensitive member, the single-layer type photosensitive layer 3*c* contains the charge generating material.

The charge generating material is not especially limited as long as it is a charge generating material for a photosensitive member. Examples of the charge generating material include phthalocyanine-based pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (such as selenium, selenium-tellurium, selenium-arsenic, cadmium sulfide, and amorphous silicon), pyrylium salts, anthenthrone-based pigments, triphenylmethane-based pigments, threne-based pigments, toluidine-based pigments, pyrazoline-based pigments, and quinacridone-based pigments.

Examples of the phthalocyanine-based pigments include metal-free phthalocyanine represented by chemical formula (CGM-1), and metal phthalocyanine. Examples of the metal phthalocyanine include titanyl phthalocyanine represented by chemical formula (CGM-2), hydroxygallium phthalocyanine represented by chemical formula (CGM-3), and chlorogallium phthalocyanine represented by chemical formula (CGM-4). The phthalocyanine-based pigments may be crystalline or amorphous. The crystal forms (such as α-form, β-form, Y-form, V-form, and II-form) of the phthalocyanine-based pigments are not especially limited, and any of the phthalocyanine-based pigments having various crystal forms can be used.

(CGM-1)

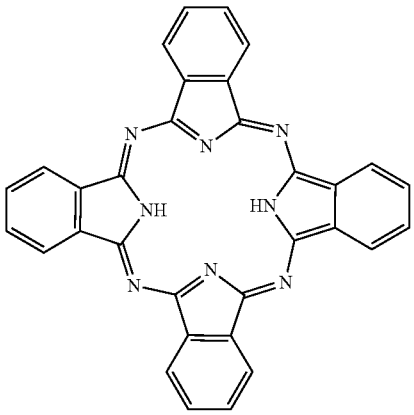

(CGM-2)

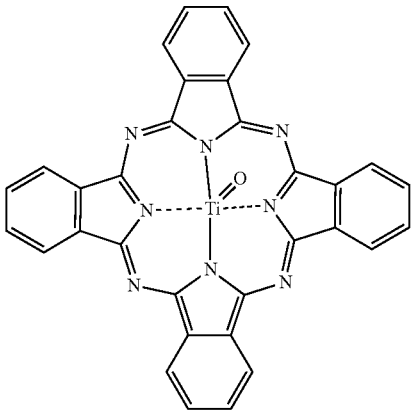

-continued (CGM-3)

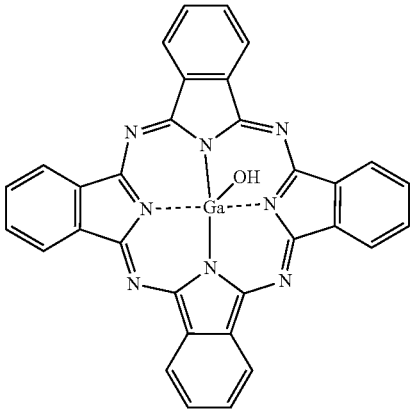

(CGM-4)

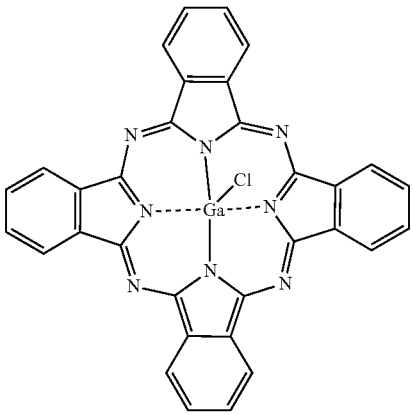

The metal-free phthalocyanine may have, for example, X-form crystal (which phthalocyanine is hereinafter sometimes referred to as the "X-form metal-free plithalocyanine"). The titanyl phthalocyanine may have, for example, α-form, β-form, or Y-form crystal (which titanyl phthalocyanine is hereinafter sometimes referred to as the "α-form, β-form, or Y-form titanyl phthalocyanine"). The hydroxygallium phthalocyanine may have V-form crystal. The chlorogallium phthocyanine may have II-form crystal. Among these, the X-form metal-free phthalocyanine and the Y-form titanyl phthalocyanine are preferably used because high quantum yield can be attained at a wavelength of 700 nm or more.

The Y-form titanyl phthalocyanine has, for example, in a CuKα characteristic X-ray diffraction spectrum, a main peak at a Bragg angle (2θ±0.2°) of 27.2°. A main peak in the CuKα characteristic X-ray diffraction spectrum refers to a peak having the largest or the second largest amplitude in a range of the Bragg angle (2θ±0.2°) of 3° or more and 40° or less.

(Method for Measuring CuKα Characteristic X-Ray Diffraction Spectrum)

An example of a method for measuring a CuKα characteristic X-ray diffraction spectrum will now be described. A sample (titanyl phthalocyanine) is filled in a sample holder of an X-ray diffractometer (for example, "RINT (registered Japanese trademark) 1100" manufactured by Rigaku Corporation), and an X-ray diffraction spectrum is measured under conditions of an X-ray tube of Cu, a tube voltage of 40 kV, a tube current of 30 mA, and a wavelength of CuKα characteristic X-ray of 1.542 Å. The measurement range (2θ) is, for example, 3° or more and 40° or less (start angle: 3°, stop angle: 40°), and a scanning speed is, for example, 10°/min.

A charge generating material having an absorption wavelength in a desired region may be singly used, or two or more charge generating materials may be used in combination. Besides, for use in, for example, a digital optical image forming apparatus (such as a laser beam printer, or a facsimile machine using a light source of a semiconductor laser or the like), the photosensitive member 1 preferably has sensitivity in a wavelength region of 700 nm or higher. Therefore, for example, phthalocyanine-based pigments are preferably used, metal-free phthalocyanine and titanyl phthalocyanine are more preferably used, and X-form metal-free phthalocyanine and Y-form titanyl phthalocyanine are particularly preferably used. One of these charge generating materials may be singly used, or two or more of these may be used in combination.

If the photosensitive member 1 is a single-layer photosensitive member, the single-layer type photosensitive layer 3*c* preferably contains titanyl phthalocyanine working as the charge generating material, and an n-type pigment described later. Thus, the abrasion resistance of the photosensitive member 1 is further improved, and the electric characteristic of the photosensitive member 1 can be more easily improved.

If the photosensitive member 1 is applied to an image forming apparatus using a short-wavelength laser light source (such as a laser light source having a wavelength of about 350 nm or higher and 550 nm or lower), an anthenthrone-based pigment is suitably used as the charge generating material.

If the photosensitive member 1 is a multi-layer photosensitive member, the content of the charge generating material is preferably 5 parts by mass or more and 1,000 parts by mass or less, and more preferably 30 parts by mass or more and 500 parts by mass or less based on 100 parts by mass of the base resin contained in the charge generating layer 3*a*.

If the photosensitive member 1 is a single-layer photosensitive member, the content of the charge generating material is preferably 0.1 parts by mass or more and 50 parts by mass or less, and more preferably 0.5 parts by mass or more and 30 parts by mass or less based on 100 parts by mass of the binder resin contained in the single-layer type photosensitive layer 3*c*.

<5. N-Type Pigment>

If the photosensitive member 1 is a multi-layer photosensitive member, the charge generating layer 3*a* may optionally contain an n-type pigment if necessary. If the photosensitive member 1 is a single-layer photosensitive member, the single-layer type photosensitive layer 3C may optionally contain an n-type pigment if necessary. If an n-type pigment is contained, the abrasion resistance of the photosensitive member 1 is likely to be improved, and the electric characteristic of the photosensitive member 1 is likely to improve.

Here, pigments are roughly divided into n-type pigments and p-type pigments. In the n-type pigments, electrons mainly work as charge carriers. In the p-type pigments, holes mainly work as charge carriers. The n-type pigments are considered to receive electrons generated for example from a charge generating material. Through the above, it is considered that the electrons and the holes generated from the charge generating material prevented from bonding together again. Examples of the n-type pigments include azo pigments, and perylene pigments.

An azo pigment used as the n-type pigment will now be described. The azo pigment is not especially limited as long as it is a compound used in an electrophotographic photosensitive member, and having an azo group (—N=N—) in a structure thereof.

As the azo pigment, any of monoazo pigments and polyazo pigments (such as bisazo pigments, trisazo pigments, and tetrakisazo pigments) can be used. Alternatively, the azo pigment may be a tautomer of a compound having an azo group. Besides, the compound having an azo group may be substituted by a chlorine atom.

As the azo pigment, any of known azo pigments may be used. Preferable examples of the azo pigments include Pigment Yellow (14, 17, 49, 65, 73, 83, 93, 94, 95, 128, 166 and 77), Pigment Orange (1, 2, 13, 34, and 36), and Pigment Red (30, 32, 61, and 144).

Specific examples of the azo pigment to be suitably used include a compound represented by chemical formula (A1) (Pigment Yellow 128), a compound represented by chemical formula (A2) (Pigment Yellow 93), a compound represented by chemical formula (A3) (Pigment Orange 13), and a compound represented by chemical formula (44) (Pigment Yellow 83).

(A1)

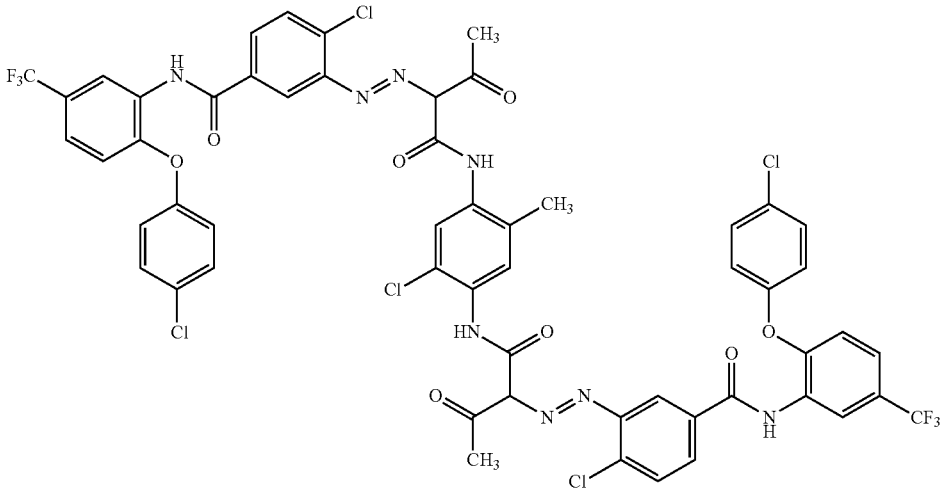

(A2)

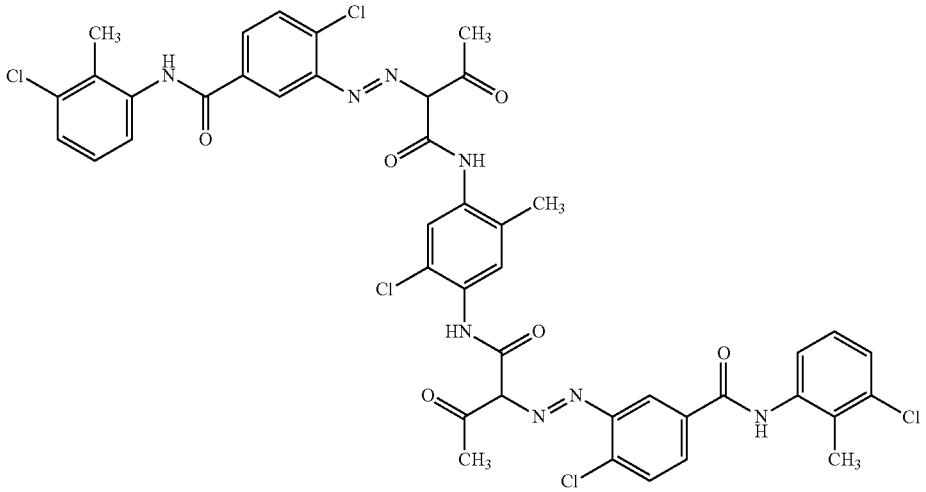

(A3)

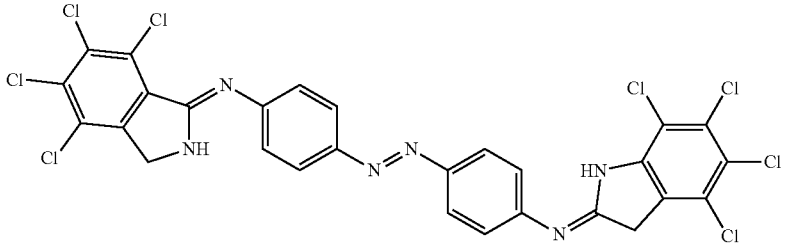

-continued (A4)

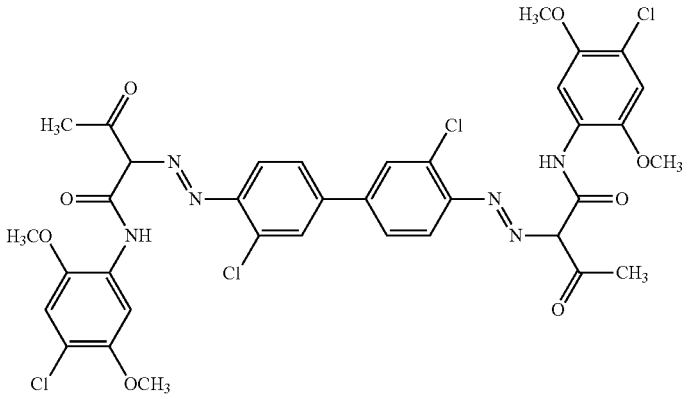

Next, a perylene pigment used as the n-type pigment will be described. The perylene pigment is, for example, a compound used in an electrophotographic photosensitive member, and having a perylene skeleton represented by general formula (10), (10)

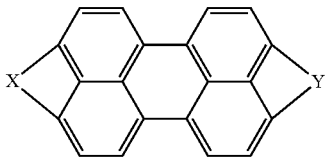

In general formula (10), X and Y each independently represent a bivalent organic group.

A preferable example of the perylene pigment includes a compound represented by general formula (11).

(11)

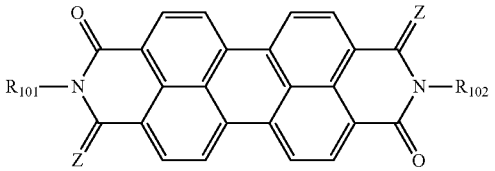

In general formula (11), $R_{101}$ and $R_{102}$ each independently represent a hydrogen atom, or a monovalent organic group, and Z represents an oxygen atom or androgen atom. Preferable examples of $R_{101}$ and $R_{102}$ of general formula (11) include a hydrogen atom, an aliphatic hydrocarbon group, an optionally substituted aralkyl group, an optionally substituted amyl group, and an optionally substituted heterocyclic group. Examples of a hetero atom contained in the heterocyclic group include a nitrogen atom, an oxygen atom, and sulfur atom.

Another preferable example of the perylene pigment includes a compound represented by general formula (12).

(12)

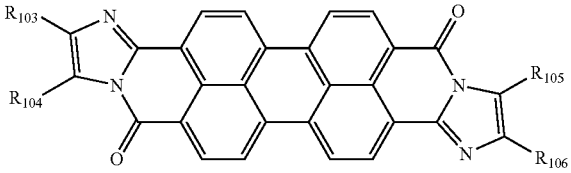

In general formula (12), $R_{103}$, $R_{104}$, $R_{105}$, and $R_{106}$ each independently represent a hydrogen atom, or a monovalent organic group, in which $R_{103}$ and $R_{104}$, or $R_{105}$ and $R_{106}$ may be bonded to each other to form a ring. In general formula (12), preferable examples of $R_{103}$, $R_{104}$, $R_{105}$, and $R_{106}$ include a hydrogen atom, an aliphatic hydrocarbon group, an aralkyl group, an aryl group, and a heterocyclic group. Examples of a hetero atom contained in the heterocyclic group include a nitrogen atom, an oxygen atom, and a sulfur atom.

The n-type pigment may be an n-type pigment different from the perylene pigments and the azo pigments. Examples of the n-type pigment different from the perylene pigments and the azo pigments include polycyclic quinone-based pigments, squarylium-based pigments, pyranthrone-based pigments, perynone-based pigments, isoindoline-based pigments, quinacridone-based pigments, pyrazolone-based pigments, and benzimidazolone-based pigments.

One of these n-type pigments may be singly used, or two or more of these may be used in combination. In order to improve the abrasion resistance of the photosensitive member 1, and to improve the electric characteristic of the photosensitive member 1, among the aforementioned n-type pigments, the azo pigments are preferably used, and the compound represented by chemical formula (A1) (i.e., Pigment Yellow 128) is more preferably used.

If the photosensitive member 1 is a single-layer photosensitive member, and the single-layer type photosensitive layer 3*c* contains titanyl phthalocyanine as the charge generating material, the single-layer type photosensitive layer 3*c* contains preferably the n-type pigment, and more preferably the azo pigment, and particularly preferably the compound represented by chemical formula (A1) (i.e., Pigment Yellow 128). Thus, the abrasion resistance of the photosensitive member 1 can be further improved, and the electric characteristic of the photosensitive member 1 can be further easily improved.

The content of the n-type pigment is preferably 0.03 parts by mass or more and 3 parts by mass or less based on 1 part by mass of the charge generating material. If the content of the n-type pigment is 0.03 parts by mass or more based on 1 part by mass of the charge generating material, dispersibility in the photosensitive layer 3 of respective raw materials tends to improve. If the content of the n-type pigment is 3 parts by mass or less based on 1 part by mass of the charge generating material, charge generation and charge injection caused by the charge generating agent tend to improve.

<6. Hole Transport Material>

If the photosensitive member 1 is a multi-layer photosensitive member, the charge transport layer 3*b* contains a hole transport material. If the photosensitive member 1 is a single-layer photosensitive member, the single-layer type photosensitive layer 3*c* contains a hole transport material. The hole transport material is a compound represented by general formula (1) (hereinafter sometimes referred to as the "compound (1)").

(1)

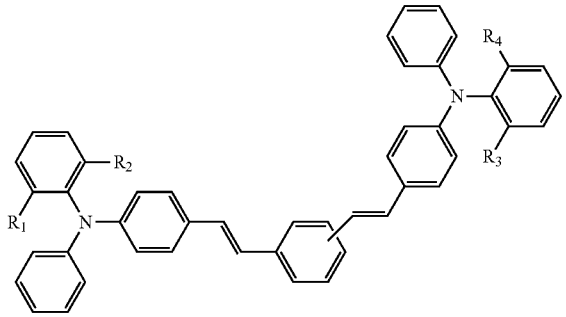

In general formula (1), $R_1$ and $R_3$ each independently represent an alkyl group, an aryl group, an aralkyl group, or an alkoxy group; and $R_2$ and $R_4$ each independently represent an alkyl group, or an alkoxy group.

The alkyl group represented by $R_1$, $R_2$, $R_3$ or $R_4$ in general formula (1) can be, for example, an alkyl group having a carbon number of at least 1 and no greater than 6, and specific examples include a methyl group, an ethyl group, an n-propyl group, an isopropyl group, an n-butyl group, an isobutyl group, a sec-butyl group, a tert-butyl group, an n-pentyl group, an isopentyl group, a neopentyl group, and a hexyl group. In order to improve the adhesion resistance of the photosensitive member 1, the alkyl group is preferably an alkyl group having a carbon number of at least 1 and no greater than 6, more preferably an alkyl group having a carbon number of at least 1 and no greater than 4, and particularly preferably a methyl group, an ethyl group, or an isopropyl group.

The alkoxy group represented by $R_1$, $R_2$, $R_3$ or $R_4$ in general formula (I) can be, for example, an alkoxy group having a carbon number of at least 1 and no greater than 6, and specific examples include a methoxy group, an ethoxy group, an n-propoxy group, isopropoxy group, an n-butoxy group, an isobutoxy group, a sec-butoxy group, a tert-butoxy group, an n-pentyloxy group, an isopentyloxy group, a neopentyloxy group, or a hexyloxy group.

Examples of the aryl group represented by $R_1$ or $R_3$ in genera formula (1) include a monocyclic aryl group having a carbon number of at least 6 and no greater than 14, and a fused (dicyclic or tricyclic) aryl group having a carbon number of at least 6 and no greater than 14. An example of the monocyclic aryl group having a carbon number of at least 6 and no greater than 14 includes a phenyl group. An example of the fused dicyclic aryl group having a carbon number of at least 6 and no greater than 14 includes a naphthyl group. Examples of the fused tricyclic aryl group having a carbon number of at least 6 and no greater than 14 include an anthryl group, and a phenanthryl group.

An example of the aralkyl group represented by $R_1$ or $R_3$ in general formula (1) includes an alkyl group having a carbon number of at least 1 and no greater than 6 and having an aryl group. The group of the alkyl group having a carbon number of at least 1 and no greater than 6 is the same as the aryl group represented by $R_1$ or $R_3$. Specific examples of the aralkyl group represented by $R_1$ or $R_3$ include a benzyl group, a 1-phenylethyl group, a 3-phenylpropyl group, a 4-phenylbutyl group, a 5-phenylpentyl group, and 6-phenylhexyl group.

A diphenylamino phenyl ethenyl group having $R_3$ and $R_4$ in general formula (1) may be positioned in any position (namely, any of the ortho-position, the meta-position, and the para-position) of a phenyl group to which the diphenylamino phenyl ethenyl group is bonded.

In order to improve the abrasion resistance of the photosensitive member 1, a compound in which $R_1$, $R_2$, $R_3$, and $R_4$ of general formula (1) are defined as follows is preferred: $R_1$ and $R_3$ each independently represent an alkyl group having a carbon number of at least 1 and no greater than 6, or an alkoxy group having a carbon number of at least 1 and no greater than 6; and $R_2$ and $R_4$ each independently represent an alkyl group having a carbon number of at least 1 and no greater than 6.

If the photosensitive member 1 is a multi-layer photosensitive member, a diphenylamino phenyl ethenyl group having $R_3$ and $R_4$ in general formula (1) is positioned preferably in the para-position of a phenyl group to which the diphenylamino phenyl ethenyl group is bonded. Thus, the abrasion resistance of the photosensitive member 1 can be improved, and the electric characteristic of the photosensitive member 1 can be more easily improved.

Specific examples of the compound (1) include compounds represented by chemical formulas (HTM-1) to (HTM-7). Hereinafter, the compounds represented by chemical formulas (HTM-1) to (HTM-7) are sometimes referred to respectively as the compounds (HTM-1) to (HTM-7).

(HTM-1)

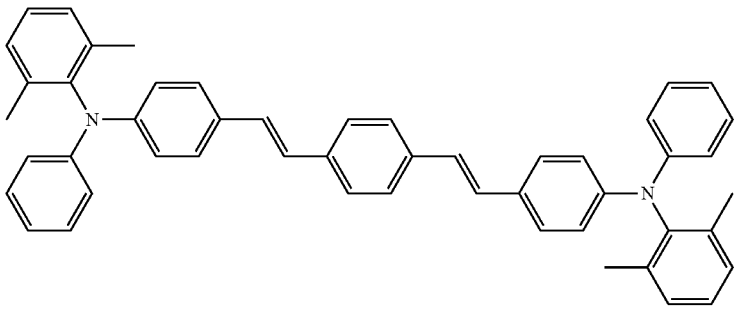

-continued
(HTM-2)
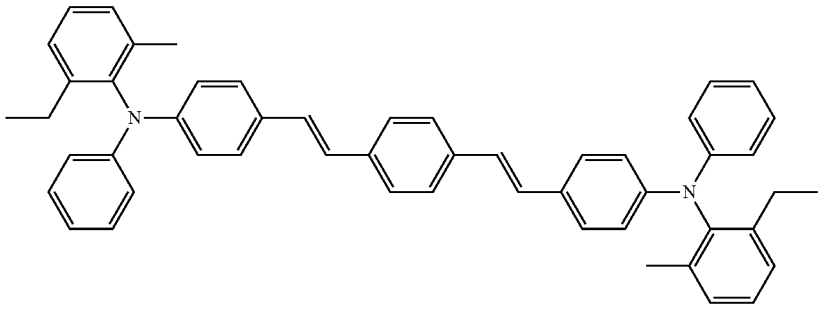
(HTM-3)
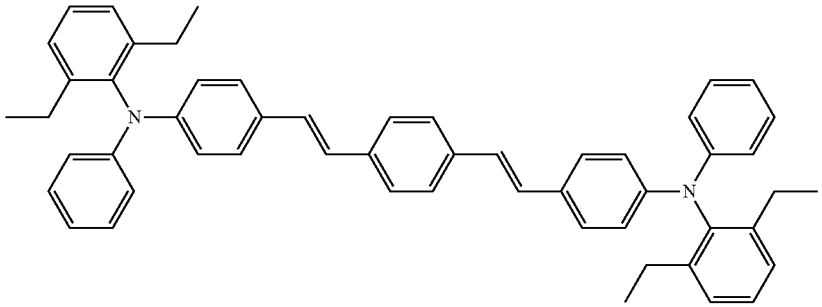
(HTM-4)
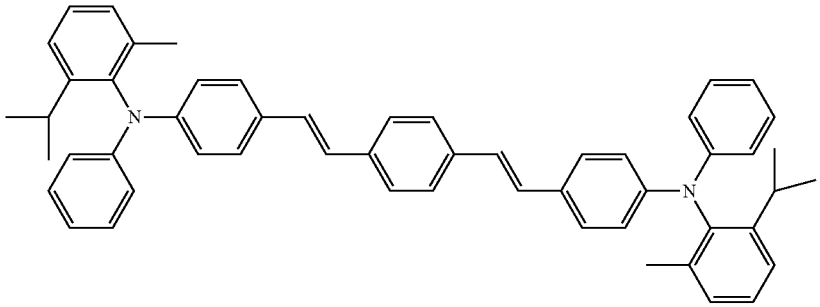
(HTM-5)
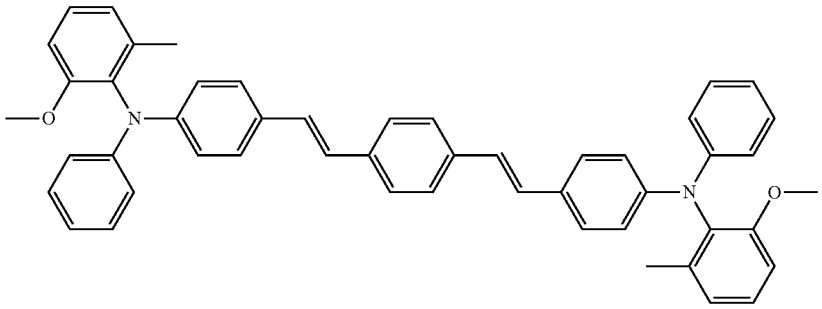
(HTM-6)
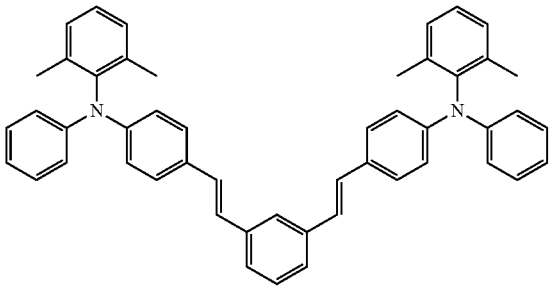
(HTM-7)
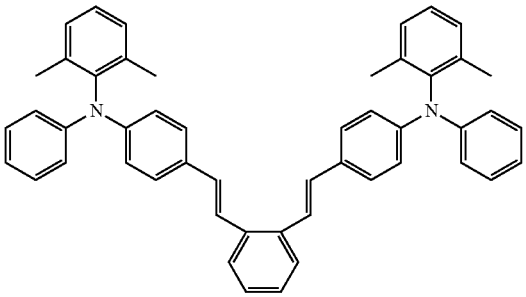

<7. Electron Transport Material and Electron Acceptor Compound>

If the photosensitive member 1 is a multi-layer photosensitive member, the charge transport layer 3*b* may optionally contain an electron acceptor compound if necessary. Thus, the hole transporting ability of the hole transport material is likely to improve. On the other hand, if the photosensitive member 1 is a single-layer photosensitive member, the single-layer type photosensitive layer 3*c* may optionally contain an electron transport material if necessary. Thus, the single-layer type photosensitive layer 3*c* can transport electrons, and hence a bipolar characteristic can be readily imparted to the single-layer type photosensitive layer 3*c*.

Examples of the electron transport material or the electron acceptor compound include quinone-based compounds, diimide-based compounds, hydrazone-based compounds, malononitrile-based compounds, thiopyran-based compounds, trinitro thioxanthone-based compounds, 3,4,5,7-tetranitro-9-fluorenone-based compounds, dinitroanthracene-based compounds, dinitroacrydine-based compounds, tetracyanoethylene, 2,4,8-trinitrothioxanthone, dinitrobenzene, dinitroaciydine, succinic anhydride, maleic anhydride, and dibromo maleic anhydride. Examples of the quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. As the electron transport material, one of these may be singly used, or two or more of these may be used in combination. Also, as the electron acceptor compound, one of these may be singly used, or two or more of these may be used in combination.

Specific examples of the electron transport material and the electron acceptor compound include compounds represented by general formula (3) to (9). Hereinafter, the compounds represented by general formulas (3) to (9) are sometimes referred to respectively as the compounds (3) to (9).

(3)

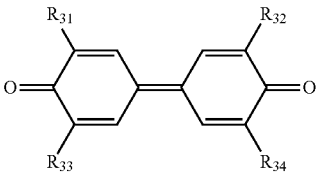

(4)

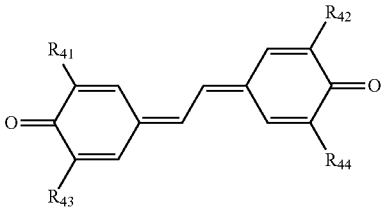

(5)

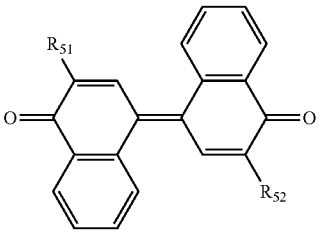

-continued (6)

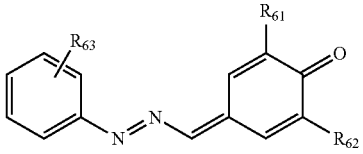

(7)

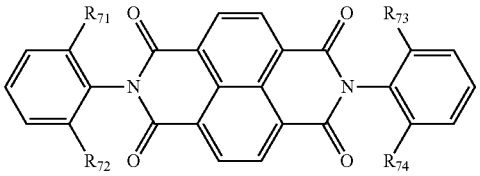

(8)

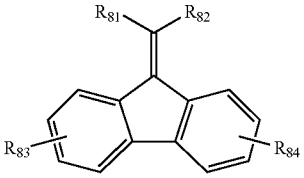

(9)

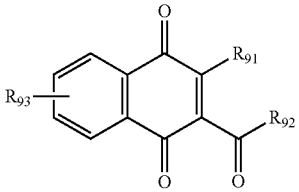

In general formulas (3) to (9), $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{82}$, $R_{83}$, $R_{84}$, $R_{91}$, $R_{92}$, and $R_{93}$ each independently represent a hydrogen atom, a cyano group, an optionally substituted alkyl group, an optionally substituted alkenyl group, an optionally substituted alkoxy group, an optionally substituted alkoxycarbonyl group, an optionally substituted aralkyl group, an optionally substituted aryl group, or an optionally substituted heterocyclic group. In general formula (6). $R_{63}$ represents a halogen atom, a hydrogen atom, an optionally substituted alkyl group, an optionally substituted alkenyl group, an optionally substituted alkoxy group, an optionally substituted aralkyl group, an optionally substituted aryl group, or an optionally substituted heterocyclic group.

The alkyl group represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{82}$, $R_{83}$, $R_{84}$, $R_{91}$, $R_{92}$, or $R_{93}$ in general formulas (3) to (9) can be, for example, an alkyl group having a carbon number of at least 1 and no greater than 10. Examples of the alkyl group having a carbon number of at least 1 and no greater than 10 include a methyl group, an ethyl group, an n-propyl group, an isopropyl group, a sec-butyl group, an n-butyl group, a tert-butyl group, an n-pentyl group, an isopentyl group, a neopentyl group, a hexyl group, a heptyl group, octyl group, a nonyl group, and a decyl group. Among these alkyl groups having a carbon number of at least 1 and no greater than 10, an alkyl group having a carbon number of at least 1 and no greater than 6 is preferred, an alkyl group having a carbon number of at least 1 and no greater than 5 is more preferred, and a methyl group, an ethyl group, an isopropyl group, a tert-butyl group, or a 1,1-dimethylpropyl group is particularly preferred. The alkyl group may be a straight chain alkyl group, a branched chain alkyl group, a cyclic alkyl group, or an alkyl group resulting from combination of any of these. The alkyl group may have a substituent. Examples of the substituent include a halogen atom, a hydroxyl group, an alkoxy group having a carbon number of at least 1 and no greater than 4, and a cyano group. The number of substituents is not especially limited, but is preferably three or less.

The alkenyl group represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{73}$, $R_{74}$, $R_{81}$, $R_{82}$, $R_{83}$, $R_{84}$, $R_{91}$, $R_{92}$, or $R_{93}$ in general formulas (3) to (9) can be, for example, an alkenyl group having a carbon number of at least 2 and no greater than 10, is preferably an alkenyl group having a carbon number of at least 2 and no greater than 6, and is more preferably an alkenyl group having a carbon number of at least 2 and no greater than 4. The alkenyl group may be a straight chain alkenyl group, a branched chain alkenyl group, a cyclic alkenyl group, or an alkenyl group resulting from combination of any of these. The alkenyl group may have a substituent. Examples of the substituent include a halogen atom, a hydroxyl group, an alkoxy group having a carbon number of at least 1 and no greater than 4, and a cyano group. The number of substituents is not especially limited, but is preferably three or less.

The alkoxy group represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{82}$, $R_{83}$, $R_{84}$, $R_{91}$, $R_{92}$, or $R_{93}$ in general formulas (3) to (9) can be, for example, an alkoxy group having a carbon number of at least 1 and no greater than 10, is preferably an alkoxy group having a carbon number of at least 1 and no greater than 6, and is more preferably an alkoxy group having a carbon number of at least 1 and no greater than 4. The alkoxy group may be a straight chain alkoxy group, a branched chain alkoxy group, a cyclic alkoxy group, or an alkoxy group resulting from combination of any of these. The alkoxy group may have a substituent. Examples of the substituent include a halogen atom, a hydroxyl group, an alkoxy group having a carbon number of at least 1 and no greater than 4, and a cyano group. The number of substituents is not especially limited, but is preferably three or less.

The alkoxycarbonyl group represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{82}$, $R_{83}$, $R_{84}$, $R_{91}$, or $R_{93}$ in general formulas (3) to (9) is a carbonyl group having an alkoxy group. The alkoxy group that the carbonyl group has is defined in the same manner as the alkoxy group represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{82}$, $R_{83}$, $R_{84}$, $R_{91}$, $R_{92}$, or $R_{93}$. The alkoxycarbonyl group may have a substituent Examples of the substituent include a halogen atom, a hydroxyl group, an alkoxy group having a carbon number of at least 1 and no greater than 4, and a cyano group. The number of substituents is not especially limited, but is preferably three or less.

The aralkyl group represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{82}$, $R_{83}$, $R_{84}$, $R_{91}$, $R_{92}$, or $R_{93}$ in general formulas (3) to (9) can be, for example, an aralkyl group having a carbon number of at least 7 and no greater than 15, is preferably an aralkyl group having a carbon number of at least 7 and no greater than 13, and is more preferably an aralkyl group having a carbon number of at least 7 and no greater than 12. The aralkyl group may have a substituent. Examples of the substituent include a halogen atom, a hydroxyl group, an alkyl group having a carbon number of at least 1 and no greater than 4, an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group containing an alkoxy group and having a carbon number of at least 1 and no greater than 4, and a phenoxycarbonyl group. The number of substituents is not especially limited, but is preferably five or less, and more preferably three or less.

Examples of the aryl group represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{82}$, $R_{83}$, $R_{84}$, $R_{91}$, $R_{92}$, or $R_{93}$ in general formulas (3) to (9) include a phenyl group, a group formed through condensation of two or three benzene rings, or a group formed by single bond of two or three benzene rings. The number of benzene rings contained in the aryl group is, for example, at least 1 and no greater than 3, and preferably at least 1 and no greater than 2. Examples of a substituent that the aryl group optionally has include a halogen atom, a hydroxyl group, an alkyl group having a carbon number of at least 1 and no greater than 4, an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group containing an alkoxy group and having a carbon number of at least 1 and no greater than 4, and a phenoxycarbonyl group.

Examples of the heterocyclic group represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{82}$, $R_{83}$, $R_{84}$, $R_{91}$, $R_{92}$, or $R_{93}$ in general formulas (3) to (9) include a heterocyclic group that is a 5- or 6-membered monocyclic ring group containing 1 or more heteroatoms selected from the group consisting of N, S, and O; a heterocyclic group obtained by fusing such monocyclic rings; and a heterocyclic group obtained by fusing such a monocyclic ring with a 5- or 6-membered hydrocarbon ring. If the heterocyclic ring is a fused ring, the number of rings contained in the fused ring is preferably three or less. Examples of a substituent that the heterocyclic group optionally has include a halogen atom, a hydroxyl group, an alkyl group having a carbon number of at least 1 and no greater than 4, an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group containing an alkoxy group and having a carbon number of at least 1 and no greater than 4, and a phenoxycarbonyl group.

Examples of the halogen atom represented by $R_{63}$ in general formula (6) include a fluoro group, a chloro group, a bromo group, and an iodo group, and a chloro group is preferred.

In order to further improve the abrasion resistance of the photosensitive member 1, the compounds (3), (4), (5), (7), (8), and (9) are preferred among the compounds (3) to (9). In order to improve the abrasion resistance of the photosensitive member 1, and to improve the electric characteristic of the photosensitive member 1, the compounds (3), (5), and (9) are more preferred.

Specific examples of the compounds (3) to (9) include compounds represented by chemical formulas (ETM-1) to (ETM-8). Hereinafter, the compounds represented by chemical formulas (ETM-1) to (ETM-8) are sometimes referred to respectively as compounds (ETM-1) to (ETM-8).

(ETM-1)

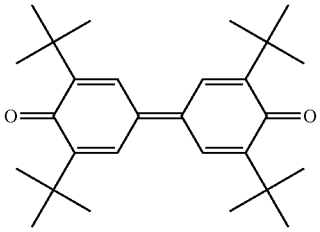

(ETM-2)

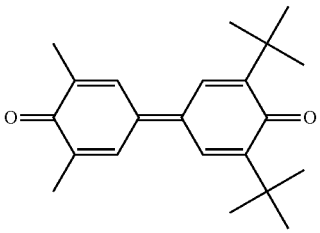

(ETM-3)

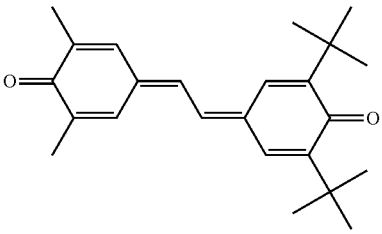

(ETM-4)

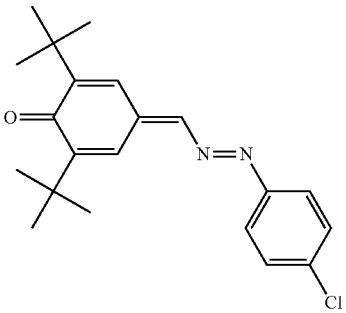

(ETM-5)

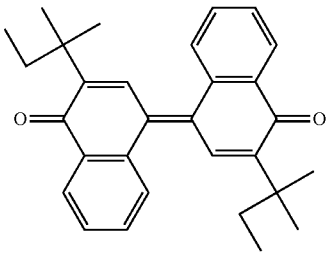

-continued (ETM-6)

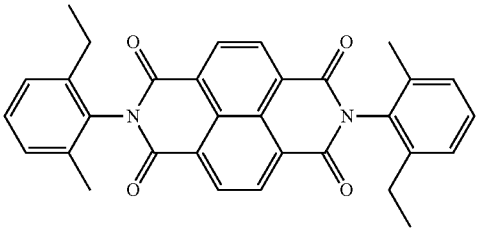

(ETM-7)

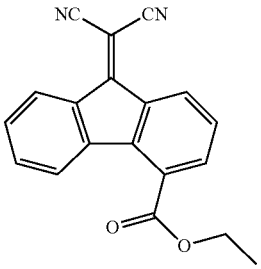

(ETM-8)

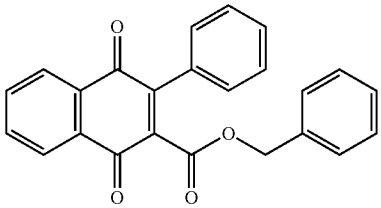

If the photosensitive member 1 is a multi-layer photosensitive member, the content of the electron acceptor compound is preferably 0.1 parts by mass or more and 20 parts by mass or less, and more preferably 0.5 parts by mass or more and 10 parts by mass or less based on 100 parts by mass of the binder resin contained in the charge transport layer 3*b*.

If the photosensitive member 1 is a single-layer photosensitive member, the content of the electron transport material is preferably 5 parts by mass or more and 100 parts by mass or less, and more preferably 10 parts by mass or more and 80 parts by mass or less based on 100 parts by mass of the binder resin contained in the single-layer type photosensitive layer 3*c*.

<8. Binder Resin>

If the photosensitive member 1 is a multi-layer photosensitive member, the charge transport layer 3*b* contains a binder resin. If the photosensitive member 1 is a single-layer photosensitive member, the single-layer type photosensitive layer 3*c* contains a binder resin. The binder resin is a resin represented by general formula (2) (hereinafter sometimes referred to as the "resin (2)").

(2)

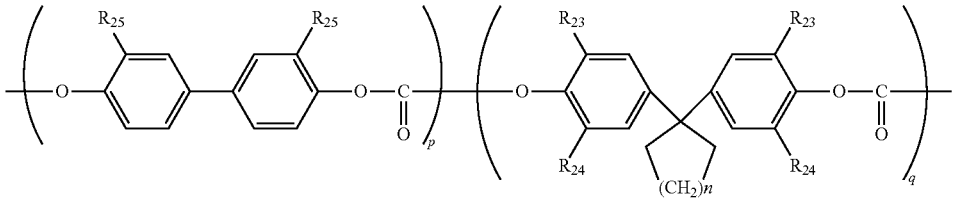

In general formula (2), $R_{23}$, $R_{24}$, and $R_{25}$ each independently represent a hydrogen atom, or an alkyl group having a carbon number of at least 1 and no greater than 4. At least one of $R_{23}$, $R_{24}$, and $R_{25}$ represents an alkyl group having a carbon number of at least 1 and no greater than 4. In other words, all of $R_{23}$, $R_{24}$, and $R_{25}$ do not simultaneously represent a hydrogen atom.

Examples of the alkyl group having a carbon number of at least 1 and no greater than 4 represented by $R_{23}$, $R_{24}$, or $R_{25}$ in general formula (2) include a methyl group, an ethyl group, an n-propyl group, an isopropyl group, an n-butyl group, a sec-butyl group, and a tert-butyl group. Among these groups, a methyl group is preferred because the abrasion resistance of the photosensitive member 1 can be thus easily improved.

In general formula (2), n represents 2 or 3. If n represents 2, a ring containing $—(CH_2)_n—$ is cyclopentane. If n represents 3, a ring containing $—(CH_2)_n—$ is cyclohexane.

The resin (2) is formed by a repeating unit represented by general formula (2a) (hereinafter sometimes referred to as the "repeating unit (2*a*)"), and a repeating unit represented by general formula (2b) (hereinafter sometimes referred to as the "repeating unit (2*b*)"). The resin (2) is a copolymer of the repeating unit (2*a*) and the repeating unit (2*b*).

(2a)

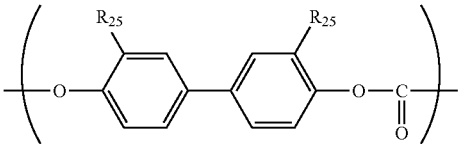

(2b)

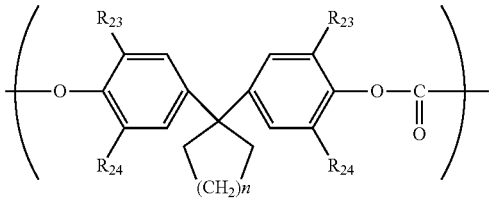

In general formulas (2a) and (2b), $R_{23}$, $R_{24}$, $R_{25}$, and n are defined in the same manner as $R_{23}$, $R_{24}$, $R_{25}$, and n of general formula (2).

In general formula (2), p and q are defined as p+q=1.00, and $0.35 \leq p < 1.00$. That is, a sum of p and q is 1.00 and p is at least 0.35 and less than 1.00. Here, p represents a ratio of the mole number of the repeating unit (2*a*) to a total mole number of the repeating unit (2*a*) and the repeating unit (2*b*) in the resin (2); and q represents a ratio of the mole number of the repeating unit (2*b*) to the total mole number of the repeating unit (2*a*) and the repeating unit (2*b*). Each of p and q is a positive number. If $0.35 \leq p < 1.00$, the resultant photosensitive member 1 attains excellent abrasion resistance. In order to further improve the abrasion resistance of the photosensitive member 1, $0.35 \leq p \leq 0.80$ is preferred, and $0.40 \leq p \leq 0.60$ is more preferred.

The resin (2) can be, for example, a random copolymer, an alternating copolymer, a periodic copolymer, or a block copolymer. The random copolymer includes random arrangement of the repeating unit (2*a*) and the repeating unit (2*b*). The alternating copolymer includes alternating arrangement of the repeating unit (2*a*) and the repeating unit (2*b*). The periodic copolymer includes periodic arrangement of one or plural repeating units (2*a*) and one or plural repeating units (2*b*). The block copolymer includes arrangement of a block of a plurality of repeating units and a block of a plurality of repeating units (2*b*).

A method for producing the resin (2) is not especially limited. An example of the method for producing the resin (2) includes a method in which interfacial polycondensation is caused between a diol compound and phosgene used for forming the repeating units of the resin (2) (what is called a phosgene method). Another example of the method for producing the resin (2) includes a method in which transesterification is caused between a diol compound and diphenyl carbonate used for forming the repeating units of the resin (2).

The following description will be given on the assumption that the resin (2) is produced by the phosgene method. The resin (2) is produced through the interfacial polycondensation of a compound represented by general formula (2am), a compound represented by general formula (2bm), and phosgene. Hereinafter, the compound represented by general formula (2am) and the compound represented by general formula (2bm) are sometimes referred to respectively as the compound (2am), and the compound (2bm). The amount of the compound (2am) to be added is equal to or larger than 35 mol % (p=0.35) and smaller than 100 mol % (p=1.00) based on a total mole number of the compound (2am) and the compound (2bm).

(2am)

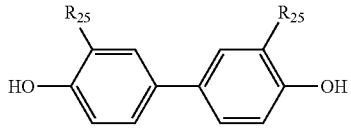

(2bm)

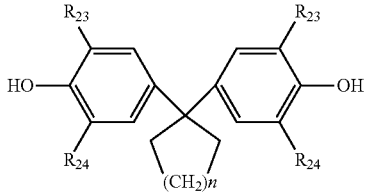

In general formulas (2am) and (2bm), $R_{23}$, $R_{24}$, $R_{25}$, and n are defined in the same manner as $R_{23}$, $R_{24}$, $R_{25}$, and n of general formula (2).

In order to improve the abrasion resistance of the photosensitive member 1, a resin in which $R_{23}$, $R_{21}$, $R_{25}$, p, q, and n of general formula (2) are defined as follows is preferred: $R_{23}$ and $R_{25}$ each independently represent a hydrogen atom, or an alkyl group having a carbon number of at least 1 and no greater than 4; at least one of $R_{23}$ and $R_{25}$ represents an alkyl group having a carbon number of at least 1 and no greater than 4; $R_{24}$ represents a hydrogen atom; p+q=1.00, and $0.40 \leq p \leq 0.60$; and n represents 2 or 3.

In order to further improve the abrasion resistance of the photosensitive member 1, a resin in which $R_{23}$, $R_{24}$, $R_{25}$, p, q, and n of general formula (2) are defined as follows is preferred: $R_{23}$ represents a hydrogen atom, or an alkyl group having a carbon number of at least 1 and no greater than 4; $R_{24}$ represents a hydrogen atom; $R_{25}$ represents an alkyl group having a carbon number of at least 1 and no greater than 4; p+q=1.00, and $0.40 \leq p \leq 0.60$; and n represents 2 or 3.

Specific examples of the resin (2) include resins represented by chemical formulas (Resin-1) to (Resin-6).

(Resin-1)

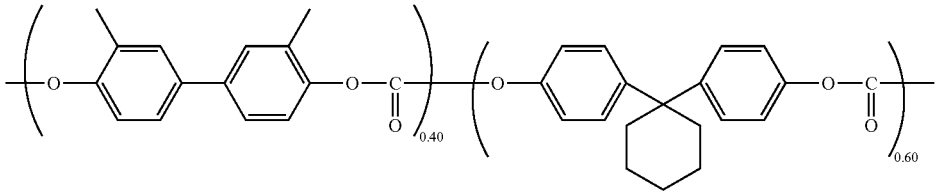

(Resin-2)

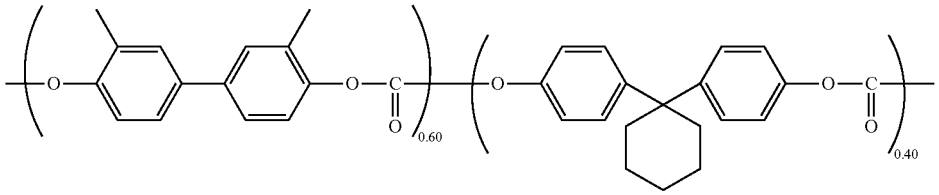

(Resin-3)

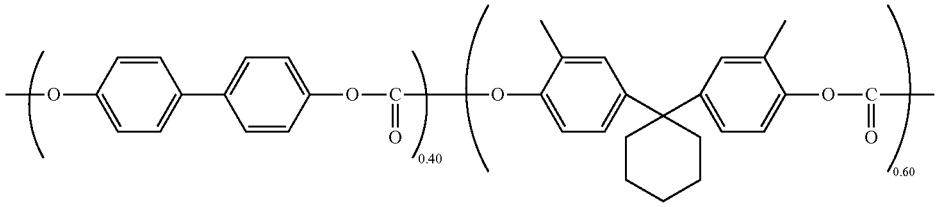

(Resin-4)

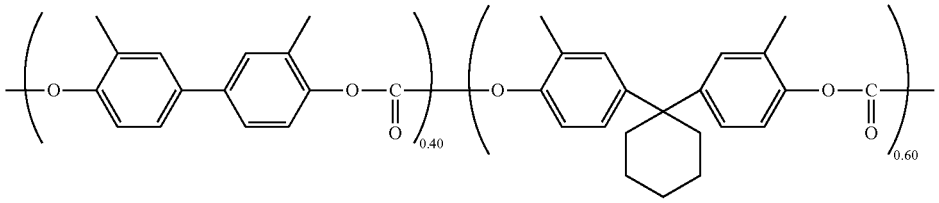

(Resin-5)

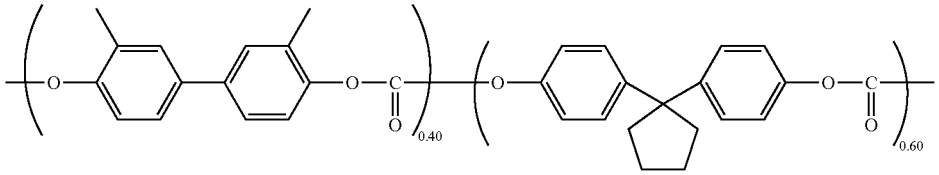

(Resin-6)

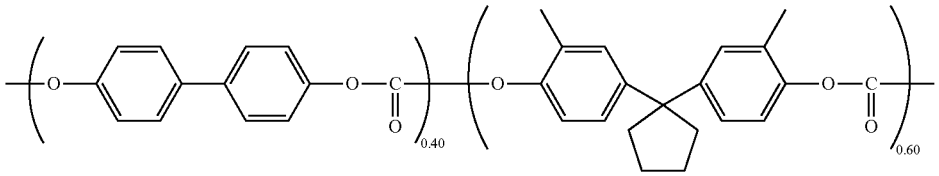

The viscosity average molecular weight of the resin (2) is preferably 40,000 or more, and more preferably 40,000 or more and 52,500 or less. If the resin (2) has a viscosity average molecular weight of 40,000 or more, the abrasion resistance of the photosensitive member 1 can be easily improved. If the molecular weight of the resin (2) is 52,500 or less, the resin (2) is readily dissolved in a solvent for forming the photosensitive layer 3, and hence, an application liquid for the charge transport layer 3*b* (hereinafter referred to as the "charge transport layer application liquid") or an application liquid for the single-layer type photosensitive layer 3*c* (hereinafter referred to as the "single-layer type photosensitive layer application liquid") is prevented from having too high viscosity. As a result, the charge transport layer 3*b* or the single-layer type photosensitive layer 3*c* can be easily formed.

The charge transport layer 3*b* or the single-layer type photosensitive layer 3*c* may contain a binder resin different from the resin (2). The different binder resin may be appropriately selected from known binder resins.

<9. Base Resin>

If the photosensitive member 1 is a multi-layer photosensitive member, the charge generating layer 3*a* contains a base resin. The base resin is not especially limited as long as it is a base resin applicable to the photosensitive member 1. The base resin can be a thermoplastic resin, a thermosetting resin, or a photo-curing resin. Examples of the thermoplastic resin include styrene-based resins, styrene-butadiene copolymers, styrene-acrylonitrile copolymers, styrene-maleic acid copolymers, styrene-acrylic acid-based copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polycarbonate resins, polyarylate resins, polysulfone resins, diallyl phthalate resins, ketone resins, polyvinyl butyral resins, polyether resins, and polyester resins. Examples of the thermosetting resin include silicone resins, epoxy resins, phenol resins, urea resins, melamine resins, and other crosslinkable thermosetting resins. Examples of the photo-curing resin include epoxy acrylic acid-based resins, and urethane-acrylic acid-based copolymers. One of these resins may be singly used, or two or more of these may be used in combination.

The base resin contained in the charge generating layer 3*a* is preferably different from the binder resin contained in the charge transport layer 3*b*. This is for the following reason: In the production of the multi-layer photosensitive member corresponding to the photosensitive member 1, for example, the charge generating layer 3*a* is formed on the conductive substrate 2, and the charge transport layer 3*b* is formed on the charge generating layer 3*a*. At this point, the charge transport layer application liquid is applied onto the charge generating layer 3*a*. Therefore, it is preferable that the charge generating layer 3*a* is insoluble in a solvent used in the charge transport layer application liquid.

<10. Additives>

The photosensitive layer 3 (specifically, the charge generating layer 3*a*, the charge transport layer 3*b*, or the single-layer type photosensitive layer 3*c*) of the photosensitive member 1 may optionally contain various additives if necessary. Examples of the additives include antidegradants (such as antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of the antioxidants include hindered phenols, hindered amines, paraphenylenediamine, arylalkanes, hydroquinone, spirochromanes, spiroindanones, derivatives of any of these compounds, organosulfur compounds, and organophosphorus compounds.

<11. Intermediate Layer>

In the photosensitive member 1, the intermediate layer 4 (in particular, the undercoat layer) is disposed between, for example, the conductive substrate 2 and the photosensitive layer 3. The intermediate layer 4 contains, for example, an inorganic particle, and a resin used for the intermediate layer 4 (an intermediate layer resin). Provision of the intermediate layer 4 may facilitate flow of current generated when the photosensitive member 1 is exposed to light and inhibit increasing resistance, while also maintaining insulation to a sufficient degree so as to inhibit leakage current from occurring.

Examples of the inorganic particle include particles of metals (such as aluminum, iron, and copper), particles of metal oxides (such as titanium oxide, alumina, zirconium oxide, tin oxide, and zinc oxide), and particles of non-metal oxides (such as silica). Any of these inorganic particles may be singly used or two or more of these inorganic particles may be used in combination.

The intermediate layer resin is not especially limited as long as it can be used as a resin for forming the intermediate layer 4. The intermediate layer 4 may contain various additives. The same additives as described above with respect to the photosensitive layer 3 can be used.

<12. Method for Producing Photosensitive Member>

A multi-layer photosensitive member corresponding to the photosensitive member 1 is produced, for example, as follows: First, an application liquid for the charge generating layer 3*a* (hereinafter referred to as the charge generating layer application liquid), and the charge transport layer application liquid are prepared. The charge generating layer application liquid is applied to the conductive substrate 2, and the resultant is dried to form the charge generating layer 3*a*. Subsequently, the charge transport layer application liquid is applied to the charge generating layer 3*a*, and the resultant is dried to form the charge transport layer 3*b*. Thus, the multi-layer photosensitive member is produced.

The charge generating layer application liquid is prepared by dissolving or dispersing, in a solvent, the charge generating material, and components added if necessary (such as the base resin, and the various additives). The charge transport layer application liquid is prepared by dissolving or dispersing, in a solvent, the hole transport material, the binder resin, and components added if necessary (such as the electron acceptor compound, and the various additives).

A single-layer photosensitive member corresponding to the photosensitive member 1 is produced, for example, as follows: The single-layer type photosensitive layer application liquid is applied to the conductive substrate 2, and the resultant is dried to produce the single-layer photosensitive member. The single-layer type photosensitive layer application liquid is prepared by dissolving or dispersing, in a solvent, the charge generating material, the hole transport material, the binder resin, and components added if necessary (such as the electron transport material, and the various additives).

The solvent used for preparing the application liquid (for the charge generating layer 3*a*, the charge transport layer 3*b*, or the single-layer type photosensitive layer 3*c*) is not especially limited as long as it can dissolve or disperse the respective components to be contained in the application liquid therein. Examples of the solvent include alcohols (such as methanol, ethanol, isopropanol, and butanol), aliphatic hydrocarbons (such as n-hexane, octane, and cyclohexane), aromatic hydrocarbons (such as benzene, toluene, and xylene), halogenated hydrocarbons (such as dichloromethane, dichloroethane, carbon tetrachloride, and chlorobenzene), ethers (such as dimethyl ether, diethyl ether, tetrahydrofuran, ethylene glycol dimethyl ether, diethylene glycol dimethyl ether, and propylene glycol monomethyl ether), ketones (such as acetone, methyl ethyl ketone, and cyclohexanone), esters (such as ethyl acetate, and methyl acetate), dimethyl formaldehyde, di methylformamide, and dimethyl sulfoxide. One of these solvents may be singly used, or two or more of these may be used in combination. Among these solvents, a non-halogenated solvent (i.e., a solvent different from a halogenated hydrocarbon) is preferably used as the solvent in order to improve the workability of an operator in the production of the photosensitive member 1.

The application liquid is prepared by mixing the respective components to be dispersed in the solvent. The components can be mixed or dispersed by using, for example, a bead mill, a roll mill, a ball mill, an attritor, a paint shaker, or an ultrasonic disperser.

The application liquid (for the charge generating layer 3*a*, the charge transport layer 3*b*, or the single-layer type photosensitive layer 3*c*) may contain, for example, a surfactant in order to improve the dispersibility of the components.

The method for applying the application liquid (for the charge generating layer 3*a*, the charge transport layer 3*b*, or the single-layer type photosensitive layer 3*c*) is not especially limited as long as the application liquid can be uniformly applied on the conductive substrate 2. Examples of the application method include dip coating, spray coating, spin coating, and bar coating.

The method for drying the application liquid (for the charge generating layer 3*a*, the charge transport layer 3*b*, or the single-layer type photosensitive layer 3*c*) is not especially limited as long as the solvent contained in the application liquid can be evaporated. An example of the method include a heat treatment (hot-air drying) using a high-temperature dryer or a reduced pressure dryer. The heat treatment is performed under conditions of a heating temperature of, for example, 40° C. or more and 150° C. or less, and a heating time of, for example, 3 minutes or more and 120 minutes or less.

The method for producing the photosensitive member 1 may further include a step of forming the intermediate layer 4 and/or a step of forming the protective layer 5 if necessary. Any of known methods can be appropriately employed in the step of forming the intermediate layer 4 and the step of forming the protective layer 5.

The photosensitive member 1 of the present embodiment has been described so far with reference to FIGS. 1A to 1C and 2A to 2C. The photosensitive member 1 of the present embodiment can attain improved abrasion resistance.

Second Embodiment: Image Forming Apparatus

A second embodiment relates to an image forming apparatus 6. One aspect of the image forming apparatus 6 of the second embodiment will now be described with reference to FIG. 3.

The image forming apparatus 6 includes a photosensitive member 1 corresponding to an image bearing member, a charging section 27, alight exposure section 28, a developing section 29, and a transfer section 26. The photosensitive member 1 corresponds to the photosensitive member 1 described in the first embodiment. The charging section 27 charges a surface of the photosensitive member 1. The light exposure section 28 exposes the charged surface of the photosensitive member 1 to light to form an electrostatic latent image on the surface of the photosensitive member 1. The developing section 29 develops the electrostatic latent image into a toner image. The transfer section 26 transfers the toner image from the photosensitive member 1 onto a transfer tar 38.

The following description will be given on the assumption that the image forming apparatus 6 employs an intermediate transfer process. The transfer process employed by the image forming apparatus 6 is, however, not limited to the intermediate transfer process, but the image forming apparatus 6 may employ direct transfer process. If the image forming apparatus 6 employs the intermediate transfer process, the transfer section 26 corresponds to a primary transfer roller 33, and a secondary transfer roller 21. The transfer target 38 corresponds to an intermediate transfer belt 20, and a recording medium (such as paper P).

The image forming apparatus 6 is not especially limited as long as it is an electrophotographic image forming apparatus. The image forming apparatus 6 may be, for example, a monochrome image forming apparatus or a color image forming apparatus. The image forming apparatus 6 may be a tandem color image forming apparatus for forming toner images of different colors by using different color toners.

The image forming apparatus 6 will now be described on the assumption of a tandem color image forming apparatus. The image forming apparatus 6 includes a plurality of photosensitive members 1 arranged in a prescribed direction and a plurality of developing sections 29. The developing sections 29 are arranged in one-to-one correspondence with the photosensitive members 1. Each of the developing sections 29 includes a development roller. The development roller bears a toner thereon, and conveys and supplies the toner to the surface of a corresponding one of the photosensitive members 1.

Figure 3:
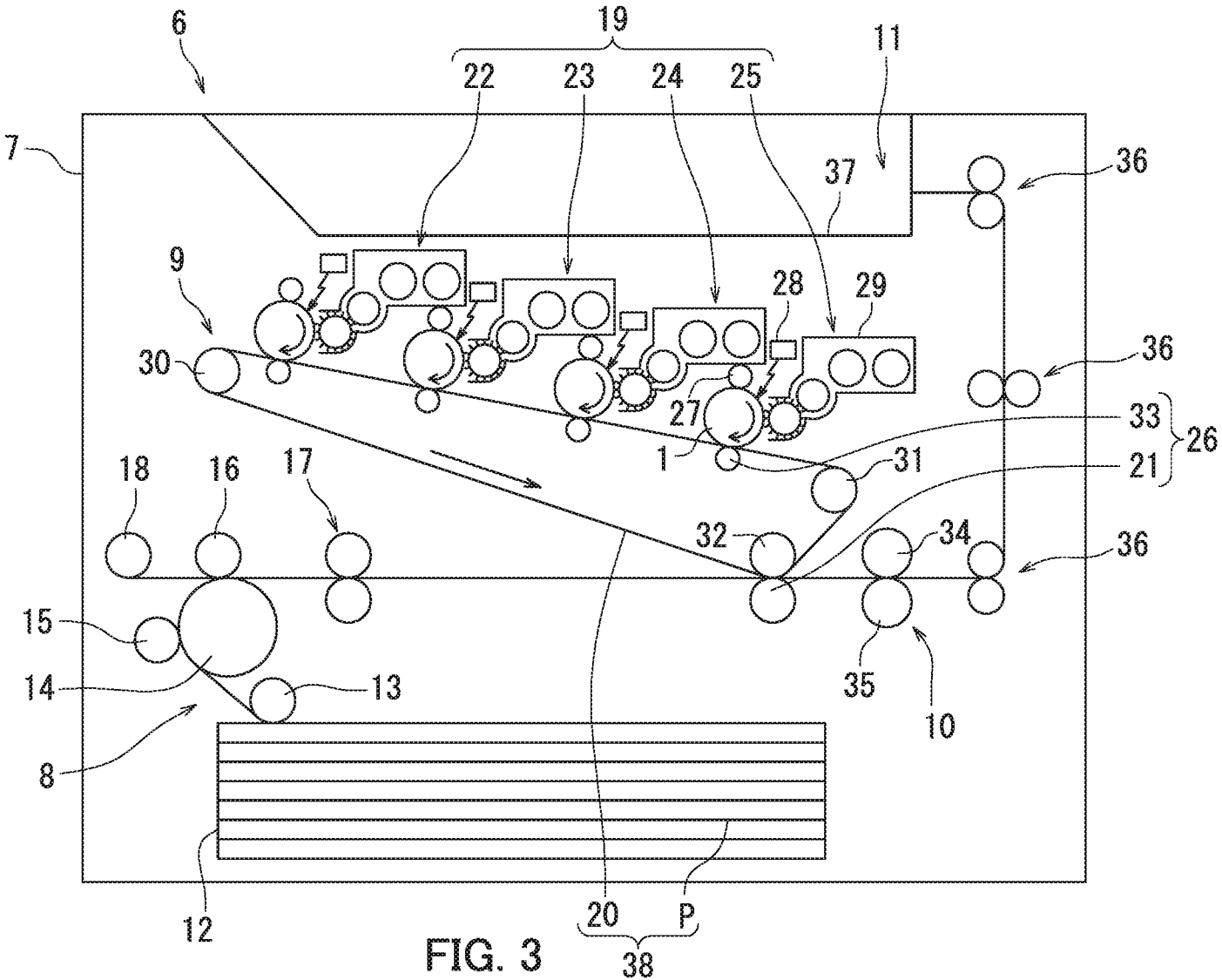
FIG. 3 is a diagram illustrating the structure of an image forming apparatus according to a second embodiment of the present disclosure.

As illustrated in FIG. 3, the image forming apparatus 6 further includes a box shaped apparatus housing 7. The apparatus housing 7 houses a paper feed section 8, an image forming section 9, and a fixing section 10. The paper feed section 8 feeds paper P. The image forming section 9 transfers a toner image based on image data onto the paper P fed from the paper feed section 8 while conveying the paper P. The fixing section 10 fixes, to the paper P, the unfixed toner image that has been transferred onto the paper P by the image forming section 9. A paper ejection section 11 is provided on a top surface of the apparatus housing 7. The paper ejection section 11 ejects the paper P after the paper P has been subjected to a fixing process by the fixing section 10.

The paper feed section 8 includes a paper feed cassette 12, a first pick-up roller 13, paper feed rollers 14, 15, and 16, and a pair of registration rollers 17. The paper feed cassette 12 is detachable from the apparatus housing 7. Various sizes of paper P can be loaded into the paper feed cassette 12. The first pick-up roller 13 is located above a left-hand side of the paper feed cassette 12. The first pick-up roller 13 picks up paper P one sheet at a time from the paper feed cassette 12 in which the paper P is loaded. The paper feed rollers 14, 15, and 16 convey the paper P that is picked up by the first pick-up roller 13. The pair of registration rollers 17 temporarily halts the paper P that is conveyed by the paper feed rollers 14, 15, and 16, and subsequently feeds the paper P to the image forming section 9 at a specific timing.

The paper feed section 8 further includes a manual feed tray (not illustrated) and a second pick-up roller 18. The manual feed tray is attached to a left side surface of the apparatus housing 7. The second pick-up roller 18 picks up paper P that is loaded on the manual feed tray. The paper P that is picked up by the second pick-up roller 18 is then conveyed by the paper feed roller 16, and fed to the image forming section 9 at the specific timing by the pair of registration rollers 17.

The image forming section 9 includes an image forming unit 19, an intermediate transfer belt 20, and a secondary transfer roller 21. The image forming unit 19 performs primary transfer of a toner image onto a surface of the intermediate transfer belt 20 (a surface in contact with the surface of the photosensitive member 1). The toner image that is subjected to the primary transfer is formed based on image data that is transmitted from a higher-level device such as a computer. The secondary transfer roller 21 performs secondary transfer of the toner image on the intermediate transfer belt 20 to paper P that is fed from the paper feed cassette 12.

In the image forming unit 19, a yellow toner supply unit 25, a magenta toner supply unit 24, a cyan toner supply unit 23, and a black toner supply unit 22 are arranged in stated order from upstream (right-hand side of FIG. 3) to downstream of a rotation direction of the intermediate transfer belt 20. The photosensitive member 1 is provided at a central position in a corresponding one of the toner supply units 22, 23, 24, and 25. The photosensitive member 1 is rotatable in an arrow direction (i.e., clockwise). The toner supply units 22, 23, 24, and 25 may be process cartridges to be described later that are attached to or detached from the body of the image forming apparatus 6.

Around each of the photosensitive member 1, the charging section 27, the light exposure section 28, and the developing section 29 are arranged in stated order from upstream to downstream of a rotation direction of the photosensitive member 1.

A static eliminator (not illustrated and a cleaning device not illustrated) may be provided upstream of the charging section 27 in the rotation direction of the photosensitive member 1. After the primary transfer of a toner image onto the intermediate transfer belt 20 is completed, the static eliminator eliminates static electricity from the circumferential surface of the photosensitive member 1. After the surface of the photosensitive member 1 has been cleaned by the cleaning device and static electricity has been eliminated from the surface by the static eliminator, the circumferential surface of the photosensitive member 1 returns to a position corresponding to the charging section 27 and anew charging process is performed. In a configuration in which the image forming apparatus 6 includes the cleaning devices and/or the static eliminators, around each of the photosensitive members 1, the charging section 27, the light exposure section 28, the developing section 29, the primary transfer roller 33, the cleaning device, and the static eliminator are arranged in stated order from upstream to downstream of the rotation direction of the photosensitive member 1.

As already mentioned above, the charging section 27 charges the surface of the photosensitive member 1. More specifically, the charging section 27 charges the circumferential surface of the photosensitive member 1 rotating in an arrow direction. In a configuration in which the photosensitive member 1 is a multi-layer photosensitive member, preferably, the charging section 27 negatively charges the surface of the photosensitive member 1. In a configuration in which the photosensitive member 1 is a single-layer photosensitive member, preferably, the charging section positively charges the surface of the photosensitive member 1. The charging section 27 may be non-contact type or contact type. The non-contact charging section 27 applies a voltage without coming into contact with the photosensitive member 1. An example of the non-contact charging section 27 includes a corona discharge type charger, and specific examples include a corotron charger and a scrotoron charger. The contact charging section 27 applies a voltage while in contact with the photosensitive member 1. An example of the contact charging section 27 includes a contact (proximity) discharge type charger, and specific examples include a charging roller and a charging brush.

An example of the charging roller includes a charging roller rotationally driven by rotation of the photosensitive member 1 while in contact with the photosensitive member 1. In the charging roller, for example, at least a surface portion is made of a resin. More specifically, the charging roller includes a metal core that is axially supported in a rotatable manner, a resin layer formed on the metal core, and a voltage application section that applies a voltage to the metal core. If the charging section 27 includes such a charging roller, the surface of the photosensitive member 1 can be charged via the resin layer in contact with the photosensitive member 1 by applying a voltage to the metal core by the voltage application section.

The resin used for forming the resin layer of the charging roller is not especially limited as long as the surface (for example, circumferential surface) of the photosensitive member 1 can be satisfactorily charged. Specific examples of the resin used for forming the resin layer include silicone resins, urethane resins, and silicone modified resins. The resin layer may optionally contain an inorganic filler.

If the image forming apparatus 6 includes the contact charging section 27, emission of active gases (for example, ozone and nitrogen oxides) produced by the charging section 27 can be suppressed. As a result, degradation of the photosensitive layer 3 otherwise caused by the active gases can be inhibited while realizing apparatus design in consideration of an office environment.

The voltage applied by the charging section 27 is not especially limited, and examples of the voltage include an alternating current voltage, a superimposed voltage of an alternating current voltage superimposed on a direct current voltage, and a direct current voltage. In particular, the charging section 27 preferably applies merely a direct current voltage. The charging section 27 applying merely a direct current voltage is superior, in the following points, to a charging section applying an alternating current voltage or a charging section applying a superimposed voltage of an alternating current voltage superimposed on a direct current voltage. If the charging section 27 applies merely a direct current voltage, the value of a voltage applied to the photosensitive member 1 is constant, and hence, the surface of the photosensitive member 1 can be easily charged uniformly to a prescribed potential. Besides, if the charging section 27 applies merely a direct current voltage, abrasion of the photosensitive layer 3 tends to be smaller. As a result, suitable images can be formed.

The voltage applied by the charging section 27 to the photosensitive member 1 is preferably 1,000 V or more and 2,000 V or less, more preferably 1,200 V or more and 1,800 V or less, and particularly preferably 1,400 V or more and 1,600 V or less.

The light exposure section 28 is, for example, a light exposure device, and more specifically, can be a laser scanning unit. The light exposure section 28 forms an electrostatic latent image on the surface of the photosensitive member 1 by exposing the charged surface of the photosensitive member 1 to light. More specifically, after the circumferential surface of the photosensitive member 1 has been uniformly charged by the charging section 27, the light exposure section 28 irradiates the circumferential surface of the photosensitive member 1 with laser light based on image data input from a higher-level device such as a personal computer. Thus, an electrostatic latent image based on the image data is formed on the circumferential surface of the photosensitive member 1.

The developing section 29 develops the electrostatic latent image into a toner image. More specifically, the developing section 29 forms a toner image based on the image data by supplying a toner to the circumferential surface of the photosensitive member 1 having the electrostatic latent image formed thereon. The developing section 29 can be, for example, a developing device.

The transfer section 26 (corresponding to the primary transfer rollers 33, and the secondary transfer roller 21) transfers the toner image formed on the surface of the photosensitive member 1 onto the transfer target 38 (corresponding to the intermediate transfer belt 20, and the paper P). The intermediate transfer belt 20 is a rotating endless belt. The intermediate transfer belt 20 is stretched around a drive roller 30, a driven roller 31, a backup roller 32, and the plural primary transfer rollers 33. The intermediate transfer belt 20 is disposed such that the circumferential surface of each of the photosensitive members 1 is in contact with the surface (contact surface) of the intermediate transfer belt 20.

The intermediate transfer belt 20 is pressed against each of the photosensitive members 1 by a corresponding one of the primary transfer rollers 33 that is located to oppose the photosensitive member 1. The intermediate transfer belt 20 is endlessly rotated by the drive roller 30 in an arrow direction (i.e., counterclockwise) while in the pressed state. The drive roller 30 is rotationally driven by a drive source such as a stepper motor and imparts driving force for the endless rotation of the intermediate transfer belt 20. The driven roller 31, the backup roller 32, and the plural primary transfer rollers 33 are freely rotatable. The driven roller 31, the backup roller 32, and the primary transfer rollers 33 passively rotate in accompaniment to the endless rotation of the intermediate transfer belt 20 caused by the drive roller 30. The driven roller 31, the backup roller 32, and the primary transfer rollers 33 passively rotate via the intermediate transfer belt 20, in response to active rotation of the drive roller 30, while supporting the intermediate transfer belt 20.

Each of the primary transfer rollers 33 applies a primary transfer bias (specifically, a bias of opposite polarity to the toner charging polarity) to the intermediate transfer belt 20. As a result, the toner images formed on the photosensitive members 1 are successively transferred (as the primary transfer) onto the rotating intermediate transfer belt 20 between each of the photosensitive members 1 and the corresponding primary transfer roller 33. It is noted that the toner has a positive charging polarity.

The secondary transfer roller 21 applies a secondary transfer bias (specifically, a bias of opposite polarity to the toner images) to the paper P. As a result, the toner images that have been transferred onto the intermediate transfer belt 20 through the primary transfer are transferred onto the paper P between the secondary transfer roller 21 and the backup roller 32. Thus, an unfixed toner image is transferred onto the paper P.

The fixing section 10 fixes, to the paper P, the unfixed toner image that has been transferred onto the paper P by the image forming section 9. The fixing section 10 includes a heating roller 34 and a pressure roller 35. The heating roller 34 is heated by a conductive heating element. The pressure roller 35 is located to oppose the heating roller 34 and has a circumferential surface that is pressed against a circumferential surface of the heating roller 34.

The transferred image that has been transferred onto the paper P by the secondary transfer roller 21 in the image forming section 9 is subsequently fixed to the paper P through a fixing process in which the paper P is heated as the paper P passes between the heating roller 34 and the pressure roller 35. After the paper P has been subjected to the fixing process, the paper P is ejected to the paper ejection section 11. A plurality of conveyance rollers 36 are provided at appropriate locations between the fixing section 10 and the paper ejection section 11.

The paper ejection section 11 is formed by a recess formed in a top part of the apparatus housing 7. An exit tray 37 for receiving the ejected paper P is provided at the bottom of the recess.

The image forming apparatus 6 according to the present embodiment has been described so far with reference to FIG. 3. The image forming apparatus 6 of the present embodiment includes the photosensitive member 1 of the first embodiment excellent in the abrasion resistance. Therefore, it is presumed that the image forming apparatus 6 of the present embodiment can inhibit occurrence of image defects over a long period of time owing to this photosensitive member 1.

Third Embodiment: Process Cartridge

A third embodiment relates to a process cartridge. One aspect of the process cartridge according to the third embodiment will now be described also with reference to FIG. 3. The process cartridge is a cartridge for image formation. The process cartridge corresponds to each of the yellow toner supply units 25, the magenta toner supply units 24, the cyan toner supply units 23, and the black toner supply units 22. The process cartridge includes the photosensitive member 1 of the first embodiment in, for example, a unitized form. The process cartridge may be designed to be removably attached to the image forming apparatus 6 of the second embodiment. The process cartridge may include, in addition to the photosensitive member 1, for example, at least one selected from the group consisting of the charging section 27, the light exposure section 28, the developing section 29, and the transfer section 26 described in the second embodiment. The process cartridge may include one of or both of the cleaning device and the static eliminator if necessary.

The process cartridge of the present embodiment has been described so far. The process cartridge of the present embodiment includes the photosensitive member 1 of the first embodiment. The photosensitive member 1 is excellent in the abrasion resistance. Therefore, if the process cartridge including this photosensitive member 1 is provided in the image forming apparatus 6, it is presumed that the occurrence of image detects can be inhibited over a long period of time. Besides, such a process cartridge is easy to handle, and hence, if the sensitivity characteristic or the like of the photosensitive member 1 is degraded, the process cartridge including the photosensitive member 1 can be easily and rapidly exchanged.

EXAMPLES

The present disclosure will now be described more specifically with reference to examples. It is noted that the present disclosure is not limited to the scope of these examples.

<1. Materials of Photosensitive Member>

As materials for forming a charge generating layer and a charge transport layer of a multi-layer photosensitive member, charge generating materials, hole transport materials, and binder resins mentioned below were prepared. As materials for forming a single-layer type photosensitive layer of a single-layer photosensitive member, charge generating materials, hole transport materials, binder resins, electron transport materials, and an n-type pigment mentioned below were prepared.

(Charge Generating Materials)

Charge generating materials (CGM-1X) and (CGM-2Y) were prepared as the charge generating materials. The charge generating material (CGM-1X) was the metal-free phthalocyanine represented by chemical formula (CGM-1) described in the embodiment. The charge generating material (CGM-1X) had X-form crystal.

The charge generating material (CGM-2Y) was the titanyl phthalocyanine represented by chemical formula (CGM-2) described in the embodiment. The charge generating material (CGM-2Y) had Y-form crystal.

(Hole Transport Materials)

The compounds (HTM-1) to (HTM-7) described in the embodiment were prepared as the hole transport materials. Compounds represented by chemical formulas (HTM-8) to (HTM-10) were also prepared. Hereinafter, the compounds represented by chemical formulas (HTM-8) to (HTM-10) are sometimes referred to respectively as the compounds (HTM-8) to (HTM-10).

(HTM-8)

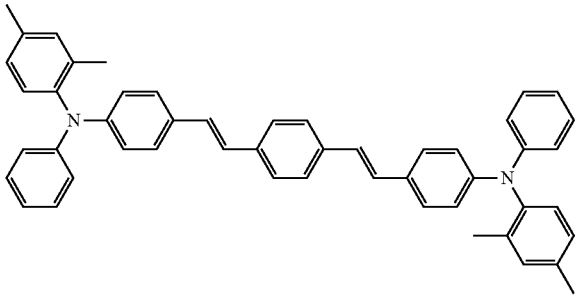

(HTM-9)

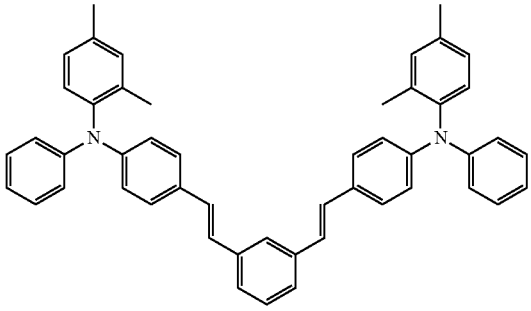

(HTM-10)

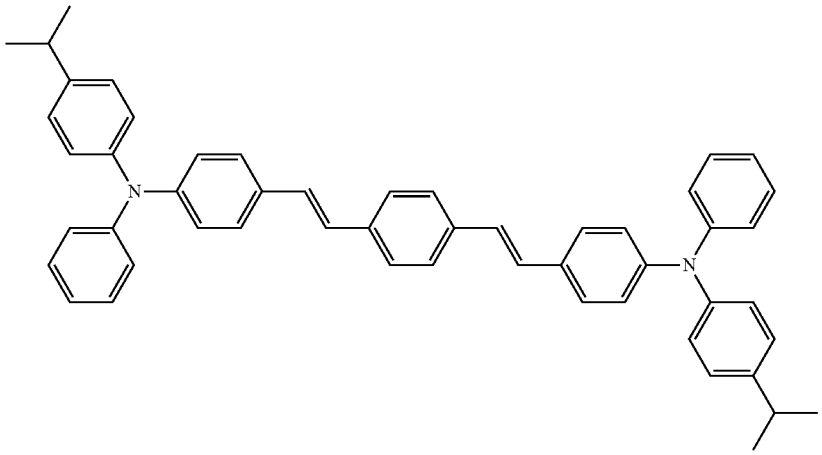

(Electron Transport Materials)

The compounds (ETM-2) to (ETM-8) described in the embodiment were prepared as the electron transport materials.

(Binder Resins)

Binder resins (Resin-1a) to (Resin-8a) were prepared as the binder resins. The binder resins (Resin-1a) to (Resin-6a) respectively corresponded to the resins represented by chemical formulas (Resin-1) to (Resin-6) described in the embodiment. The binder resin (Resin-1a) had a viscosity average molecular weight of 50,100. The binder resin (Resin-2a) had a viscosity average molecular weight of 50,300. The binder resin (Resin-3a) had a viscosity average molecular weight of 50,200. The binder resin (Resin-4a) had a viscosity average molecular weight of 50,200. The binder resin (Resin-5a) had a viscosity average molecular weight of 50,500. The binder resin (Resin-6a) had a viscosity average molecular weight of 50,000.

The binder resins (Resin-7a) and (Resin-8a) respectively corresponded to resins represented by chemical formulas (Resin-7) and (Resin-8). In chemical formulas (Resin-7) and (Resin-8), a subscript of each repeating unit represents a mole fraction of the repeating unit. The binder resin (Resin-7a) had a viscosity average molecular weight of 49,700. The binder resin (Resin-8a) had a viscosity average molecular weight of 50,300.

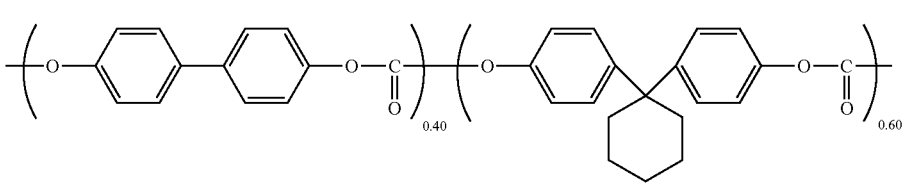

(Resin-7)

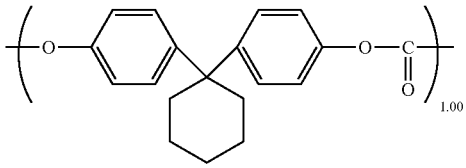

(Resin-8)

(N-Type Pigment)

The compound represented by chemical formula (A1) described in the embodiment (hereinafter sometimes referred to as the compound (A1)) was prepared as the n-type pigment.

<2. Production of Multi-Layer Photosensitive Members>

Multi-layer photosensitive members (A-1) to (A-12) and (B-1) to (B-13) were produced using the prepared materials for forming the photosensitive layers.

<2-1. Production of Multi-Layer Photosensitive Member (A-1)>

First, surface-treated titanium oxide ("Prototype SMT-A" manufactured by Tayca Corporation, having a number average primary particle size of 10 nm) was prepared. The surface-treated titanium oxide was prepared as follows: Titanium oxide was surface treated with alumina and silica. The titanium oxide thus surface treated was further surface treated with methyl hydrogen polysiloxane with wet dispersion.

Next, an application liquid for an intermediate layer (hereinafter referred to as the intermediate layer application liquid) was prepared. Specifically, a vessel was charged with 2 parts by mass of the surface-treated titanium oxide, 1 part by mass of 6, 12, 66, 610 quatercopolymer polyamide resin ("Amilan (registered Japanese trademark) CM8000" manufactured by Toray Industries Inc.), and a mixed solvent. The mixed solvent was obtained by mixing 10 parts by mass of methanol, 1 part by mass of butanol, and 1 part by mass of toluene. The contents of the vessel were mixed for 5 hours using a bead mill to disperse the materials in the mixed solvent. Thus, the intermediate layer application liquid was obtained.

Next, an intermediate layer (an undercoat layer) was formed. Specifically, the thus obtained intermediate layer application liquid was filtered through a 5 μm filter. The resultant intermediate layer application liquid was applied to a surface of an aluminum drum-shaped support (having a diameter of 30 nm, and a length of 246 mm) used as a conductive substrate by dip coating. Thereafter, the applied intermediate layer application liquid was heated at 130° C. for 30 minutes. In this manner, the intermediate layer (with a thickness of 1 μm) was formed on the conductive substrate.

Next, a charge generating layer application liquid was prepared. Specifically, a vessel was charged with 1.5 parts by mass of the charge generating material (CGM-2Y), 1 part by mass of a polyvinyl acetal resin ("S-LEK KS-6Z" manufactured by Sekisui Chemical Co., Ltd.) used as a base resin, and a mixed solvent (a dispersion medium). The mixed solvent was obtained by mixing 40 parts by mass of propylene glycol monomethyl ether and 40 parts by mass of tetrahydrofuran. The contents of the vessel was mixed for 2 hours using a bead mill to disperse the materials in the mixed solvent. Thus, the charge generating layer application liquid was obtained. Next, the thus obtained charge generating layer application liquid was filtered through a 3 μm filter. Thereafter, the charge generating layer application liquid was applied, by dip coating, to the conductive substrate on which the intermediate layer had been formed. Subsequently, the applied charge generating layer application liquid was dried at 50° C. for 10 minutes. In this manner, a charge generating layer (having a thickness of 0.3 μm) was formed above the conductive substrate on which the intermediate layer had been formed.

Next, a charge transport layer application liquid was prepared. Specifically, 45 parts by mass of the compound (HTM-1) used as a hole transport material, 100 parts by mass of the binder resin (Resin-1a), 0.5 parts by mass of BI-IT (butylated hydroxytoluene) used as an additive, 3 parts by mass of m-terphenyl used as an additive, 420 parts by mass of tetrahydrofuran used as a solvent, and 210 parts by mass of toluene used as a solvent were mixed. Thus, the materials were dissolved in the solvents. As a result, the charge transport layer application liquid was obtained. The thus obtained charge transport layer application liquid was applied, by the same method as the charge generating layer application liquid, to the conductive substrate on which the intermediate layer and the charge generating layer had been formed. Subsequently, the applied charge transport layer application liquid was dried at 120° C. for 40 minutes. Thus, a charge transport layer (having a thickness of 20 μm) was formed above the conductive substrate on which the intermediate layer and the charge generating layer had been formed. As a result, the multi-layer photosensitive member (A-1) was obtained.

<2-2. Production of Multi-Layer Photosensitive Members (A-2) to (A-12) and (B-1) to (B-13)>

The multi-layer photosensitive members (A-2) to (A-12) and (B-1) to (B-13) were produced in the same manner as the multi-layer photosensitive member (A-1) except for the following: The compound (HTM-1) corresponding to the hole transport material and the binder resin (Resin-1a) used in the production of the multi-layer photosensitive member (A-1) were respectively replaced with hole transport materials (HIM) and binder resins shown in Tables 1 and 2.

<3. Production of Single-Layer Photosensitive Members>

Single-layer photosensitive members (A-13) to (A-36) and (B-14) to (B-19) were produced using the prepared materials for forming the photosensitive layers.

<3-1. Production of Single-Layer Photosensitive Member (A-13)>

A vessel was charged with 3 parts by mass of the charge generating material (CGM-1X), 50 parts by mass of the compound (HTM-1) used as a hole transport material, 20 parts by mass of the compound (ETM-2) used as an electron transport material, 100 parts by mass of the binder resin (Resin-1a), and 800 parts by mass of tetrahydrofuran used as a solvent. The contents of the vessel were mixed using an ultrasonic disperser to disperse the materials in the solvent. Thus, a single-layer type photosensitive layer application liquid was obtained. The thus obtained single-layer type photosensitive layer application liquid was applied to a conductive substrate (an aluminum tube) by dip coating. The applied single-layer type photosensitive layer application liquid was dried at 100° C. for 30 minutes. Thus, a single-layer type photosensitive layer (having a thickness of 25 μm) was formed on the conductive substrate. As a result, the single-layer photosensitive member (A-13) was produced.

<3-2. Production of Single-Layer Photosensitive Members (A-14) to (A-24) and (B-14) to (B-19)>

The single-layer photosensitive members (A-14) to (A-24) and (B-14) to (B-19) were produced in the same manner as the single-layer photosensitive member (A-13) except for the following: The compound (HTM-1) corresponding to the hole transport material, and the binder resin (Resin-1a) used in the production of the single-layer photosensitive member (A-13) were respectively replaced with hole transport materials (HTM) and binder resins shown in Tables 3 and 5.

<3-3. Production of Single-Layer Photosensitive Members (A-25) to (A-36)>

The single-layer photosensitive members (A-25) to (A-36) were produced in the same manner as the single-layer photosensitive member (A-13) except for the following: The charge generating material (CGM-2Y), the compound corresponding to the hole transport material, and the compound (ETM-2) corresponding to the electron transport material used in the production of the single-layer photosensitive member (A-13) were respectively replaced with charge generating materials (CGM), hole transport materials (HIM) and electron transport materials (ETM) shown in Table 4. In addition, 1 part by mass of the compound (A1) used as the n-type pigment was added to the vessel in addition to the materials for each of the photosensitive members.

<4. Evaluation of Electric Characteristic of Multi-Layer Photosensitive Members>

The multi-layer photosensitive members (A-1) to (A-12) and (B-1) to (B-13) were evaluated for the electric characteristic. The evaluation of the electric characteristic was carried out under an environment of a temperature of 10° C. and a humidity of 20% RH. First, a drum sensitivity testing machine (manufactured by GENTEC Co., Ltd.) was used for negatively charging the surface of each of the multi-layer photosensitive members. As conditions for performing the charging, a rotational speed of the multi-layer photosensitive member was set to 31 rpm, and a current flowing into the multi-layer photosensitive member was set to −10 μA. Immediately after the charging, a surface potential of the multi-layer photosensitive member was measured. The surface potential of the multi-layer photosensitive member thus measured was defined as an initial surface potential ($V_0$). Subsequently, monochromatic light (having a wavelength of 780 nm, and a light intensity of 0.26 μJ/cm$^2$) was taken out from light of a halogen lamp using a band-pass filter. The resultant monochromatic light was used for irradiating the whole round surface of the multi-layer photosensitive member. When 50 msec. had elapsed after completing the irradiation, a surface potential of the multi-layer photosensitive member was measured. The surface potential thus measured was defined as a residual potential ($V_L$).

<5. Evaluation of Electric Characteristic of Single-Layer Photosensitive Members>

The single-layer photosensitive members (A-13) to (A-36) and (B-13) to (B-19) were evaluated for the electric characteristic. The evaluation of the electric characteristic was carried out under an environment of a temperature of 10° C. and a humidity of 20% RH. First, a drum sensitivity testing machine (manufactured by GENTEC Co., Ltd.) was used for positively charging the surface of each of the single-layer photosensitive members with the single-layer photosensitive member rotated at a rotational speed of 100 rpm. Immediately after the charging, a surface potential of the single-layer photosensitive member was measured. The surface potential of the single-layer photosensitive member thus measured was defined as an initial surface potential ($V_0$). Subsequently, monochromatic light (having a half width of 20 nm, a wavelength of 780 nm, and a light intensity of 1.5 μJ/cm$^2$) was taken out from light of a halogen lamp using a band-pass filter. The resultant monochromatic light was used for irradiating the whole round surface of the single-layer photosensitive member. When 100 msec. had elapsed after completing the irradiation, a surface potential of the single-layer photosensitive member was measured. The surface potential thus measured was defined as a residual potential ($V_L$).

<6. Evaluation of Abrasion Resistance of Multi-Layer Photosensitive Members>

The charge transport layer of each of the multi-layer photosensitive members (A-1) to (A-12) and (B-1) to (B-13) was evaluated for abrasion resistance. First, the charge transport layer application liquid prepared in the production of the multi-layer photosensitive member was applied to a polypropylene sheet (having a thickness of 0.3 mm) wound around an aluminum pipe (having a diameter of 78 mm). The polypropylene sheet to which the charge transport layer application liquid had been applied was dried at 120° C. for 40 minutes. Thus, a charge transport layer (hereinafter referred to as the evaluation sheet) having a thickness of 30 μm was formed on the polypropylene sheet. Subsequently, the evaluation sheet was peeled off from the polypropylene sheet. The peeled evaluation sheet was caused to adhere to a wheel ("S-36" manufactured by TABER) to give a test piece. A mass M1 of the thus obtained test piece (that is, the mass of the test piece prior to an abrasion test was measured.

Thereafter, the test piece was subjected to the abrasion test. Specifically, the test piece was loaded on a rotary table of a rotary abrasion tester (manufactured by Toyo Seiki Seisaku-Sho, Ltd.). With a wear ring ("CS-10" manufactured by TABER) placed on the test piece under a load of 500 gf, the rotary table was rotated at a rotational speed of 60 rpm to perform the abrasion test of 1,000 rotations. Subsequently, a mass M2 of the test piece after the abrasion test was measured. Thereafter, abrasion loss (M1-M2), that is, change in mass of the test piece caused through the abrasion test, was obtained.

On the basis of the thus obtained abrasion loss, the abrasion resistance of the multi-layer photosensitive member was evaluated in accordance with the following criteria:

(Criteria for Evaluating Abrasion Resistance of Multi-Photosensitive Member)

Excellent: Abrasion loss of less than 6.0 mg

Good: Abrasion loss of 6.0 mg or more and less than 7.0 mg

Poor: Abrasion loss of 7.0 mg or more

<7. Evaluation of Abrasion Resistance of Single-Layer Photosensitive Member>

The single-layer type photosensitive layer of each of the single-layer photosensitive members (A-13) to (A-36) and (B-14) to (B-19) was evaluated for the abrasion resistance. The evaluation of the abrasion resistance of the single-layer photosensitive members was carried out in the same manner as the evaluation of the abrasion resistance of the multi-layer photosensitive members except for the following: Instead of the charge transport layer application liquid prepared in the production of each multi-layer photosensitive member, the single-layer type photosensitive layer application liquid prepared in the production of each of the single-layer photosensitive members was used. Thus, abrasion mass (M1-M2), that is, change in mass of each test piece caused through the abrasion test, was obtained.

On the basis of the thus obtained abrasion loss, the abrasion resistance of the single-layer photosensitive member was evaluated in accordance with the following criteria:

(Criteria for Evaluating Abrasion Resistance of Single-Layer Photosensitive Member)

Excellent: Abrasion loss of less than 8.0 mg

Good: Abrasion loss of 8.0 mg or more and less than 9.0 mg

Poor: Abrasion loss of 9.0 mg or more

The evaluation results of the electric characteristic and the abrasion resistance of the multi-layer photosensitive members are shown in Tables 1 and 2. The evaluation results of the electric characteristic and the abrasion resistance of the single-layer photosensitive members are shown in Tables 3 to 5. In Tables 1 to 5, CGM, ETM, $V_0$, and $V_L$ respectively correspond to the charge generating material, the hole transport material, the electron transport material, the initial potential, and the residual potential.

TABLE 1

| Multi-layer photosensitive member | Charge transport layer: HTM | Charge transport layer: Binder resin | Electric characteristic: $V_0$ [V] | Electric characteristic: $V_L$ [V] | Abrasion resistance: Abrasion loss [mg] (per 1000 rotations) | Abrasion resistance: Evaluation |
|---|---|---|---|---|---|---|
| A-1 | HTM-1 | Resin-1a | −700 | −87 | 5.4 | Excellent |
| A-2 | HTM-2 | Resin-1a | −698 | −90 | 5.0 | Excellent |
| A-3 | HTM-3 | Resin-1a | −703 | −93 | 5.4 | Excellent |
| A-4 | HTM-4 | Resin-1a | −702 | −93 | 5.3 | Excellent |
| A-5 | HTM-5 | Resin-1a | −697 | −87 | 5.6 | Excellent |
| A-6 | HTM-6 | Resin-1a | −701 | −105 | 5.1 | Excellent |
| A-7 | HTM-7 | Resin-1a | −703 | −106 | 5.8 | Excellent |
| A-8 | HTM-1 | Resin-2a | −705 | −88 | 3.9 | Excellent |
| A-9 | HTM-1 | Resin-3a | −710 | −88 | 6.2 | Good |
| A-10 | HTM-1 | Resin-4a | −687 | −90 | 4.2 | Excellent |
| A-11 | HTM-1 | Resin-5a | −698 | −85 | 5.3 | Excellent |
| A-12 | HTM-1 | Resin-6a | −699 | −89 | 6.5 | Good |

TABLE 2

| Multi-layer photosensitive member | Charge transport layer: HTM | Charge transport layer: Binder Resin | Electric characteristic: $V_0$ [V] | Electric characteristic: $V_L$ [V] | Abrasion resistance: Abrasion loss [mg] (per 1000 rotations) | Abrasion resistance: Evaluation |
|---|---|---|---|---|---|---|
| B-1 | HTM-1 | Resin-7a | −701 | −89 | 7.2 | Poor |
| B-2 | HTM-2 | Resin-7a | −704 | −90 | 7.1 | Poor |
| B-3 | HTM-3 | Resin-7a | −695 | −85 | 7.0 | Poor |
| B-4 | HTM-4 | Resin-7a | −700 | −89 | 7.4 | Poor |
| B-5 | HTM-5 | Resin-7a | −684 | −87 | 7.3 | Poor |
| B-6 | HTM-6 | Resin-7a | −685 | −85 | 7.7 | Poor |
| B-7 | HTM-7 | Resin-7a | −702 | −90 | 7.0 | Poor |
| B-8 | HTM-1 | Resin-8a | −701 | −89 | 10.1 | Poor |
| B-9 | HTM-2 | Resin-8a | −704 | −90 | 9.5 | Poor |
| B-10 | HTM-3 | Resin-8a | −695 | −91 | 10.3 | Poor |
| B-11 | HTM-8 | Resin-1a | −700 | −89 | 7.1 | Poor |
| B-12 | HTM-9 | Resin-1a | −698 | −110 | 7.1 | Poor |
| B-13 | HTM-10 | Resin-1a | −688 | −89 | 7.0 | Poor |

TABLE 3

| Single-layer photosensitive member | Single-layer type photosensitive layer: CGM | n-type pigment | HTM | Binder resin | ETM | Electric characteristic: $V_0$ [V] | Electric characteristic: $V_L$ [V] | Abrasion resistance: Abrasion loss [mg] (per 1000 rotations) | Abrasion resistance: Evaluation |
|---|---|---|---|---|---|---|---|---|---|
| A-13 | CGM-1X | none | HTM-1 | Resin-1a | ETM-2 | +710 | +113 | 6.8 | Excellent |
| A-14 | CGM-1X | none | HTM-2 | Resin-1a | ETM-2 | +725 | +114 | 6.9 | Excellent |
| A-15 | CGM-1X | none | HTM-3 | Resin-1a | ETM-2 | +715 | +100 | 7.1 | Excellent |
| A-16 | CGM-1X | none | HTM-4 | Resin-1a | ETM-2 | +686 | +123 | 6.7 | Excellent |

TABLE 3-continued

| Single-layer photosensitive member | Single-layer type photosensitive layer | | | | | Electric characteristic | | Abrasion resistance | |
|---|---|---|---|---|---|---|---|---|---|
| | CGM | n-type pigment | HTM | Binder resin | ETM | $V_0$ [V] | $V_L$ [V] | Abrasion loss [mg] (per 1000 rotations) | Evaluation |
| A-17 | CGM-1X | none | HTM-5 | Resin-1a | ETM-2 | +702 | +123 | 7.4 | Excellent |
| A-18 | CGM-1X | none | HTM-6 | Resin-1a | ETM-2 | +704 | +115 | 6.5 | Excellent |
| A-19 | CGM-1X | none | HTM-7 | Resin-1a | ETM-2 | +705 | +110 | 6.4 | Excellent |
| A-20 | CGM-1X | none | HTM-1 | Resin-2a | ETM-2 | +710 | +112 | 5.7 | Excellent |
| A-21 | CGM-1X | none | HTM-1 | Resin-3a | ETM-2 | +707 | +111 | 8.1 | Good |
| A-22 | CGM-1X | none | HTM-1 | Resin-4a | ETM-2 | +690 | +104 | 6.7 | Excellent |
| A-23 | CGM-1X | none | HTM-1 | Resin-5a | ETM-2 | +700 | +103 | 6.4 | Excellent |
| A-24 | CGM-1X | none | HTM-1 | Resin-6a | ETM-2 | +701 | +105 | 8.6 | Good |

TABLE 4

| Single-layer photosensitive member | Single-layer type photosensitive layer | | | | | Electric characteristic | | Abrasion resistance | |
|---|---|---|---|---|---|---|---|---|---|
| | CGM | n-type pigment | HTM | Binder resin | ETM | $V_0$ [V] | $V_L$ [V] | Abrasion loss [mg] (per 1000 rotations) | Evaluation |
| A-25 | CGM-2Y | A1 | HTM-1 | Resin-1a | ETM-2 | +703 | +85 | 6.7 | Excellent |
| A-26 | CGM-2Y | A1 | HTM-2 | Resin-1a | ETM-2 | +700 | +86 | 7.0 | Excellent |
| A-27 | CGM-2Y | A1 | HTM-3 | Resin-1a | ETM-2 | +703 | +90 | 6.7 | Excellent |
| A-28 | CGM-2Y | A1 | HTM-4 | Resin-1a | ETM-2 | +707 | +87 | 6.4 | Excellent |
| A-29 | CGM-2Y | A1 | HTM-5 | Resin-1a | ETM-2 | +698 | +92 | 6.5 | Excellent |
| A-30 | CGM-2Y | A1 | HTM-6 | Resin-1a | ETM-2 | +710 | +95 | 6.9 | Excellent |
| A-31 | CGM-2Y | A1 | HTM-1 | Resin-1a | ETM-3 | +703 | +90 | 6.5 | Excellent |
| A-32 | CGM-2Y | A1 | HTM-1 | Resin-1a | ETM-4 | +711 | +91 | 7.0 | Excellent |
| A-33 | CGM-2Y | A1 | HTM-1 | Resin-1a | ETM-5 | +702 | +89 | 6.4 | Excellent |
| A-34 | CGM-2Y | A1 | HTM-1 | Resin-1a | ETM-6 | +700 | +98 | 6.6 | Excellent |
| A-35 | CGM-2Y | A1 | HTM-1 | Resin-1a | ETM-7 | +698 | +95 | 6.7 | Excellent |
| A-36 | CGM-2Y | A1 | HTM-1 | Resin-1a | ETM-8 | +693 | +70 | 6.8 | Excellent |

TABLE 5

| Single-layer photosensitive member | Single-layer type photosensitive layer | | | | | Electric characteristic | | Abrasion resistance | |
|---|---|---|---|---|---|---|---|---|---|
| | CGM | n-type pigment | HTM | Binder resin | ETM | $V_0$ [V] | $V_L$ [V] | Abrasion loss [mg] (per 1000 rotations) | Evaluation |
| B-14 | CGM-1X | none | HTM-1 | Resin-7a | ETM-2 | +710 | +114 | 9.6 | Poor |
| B-15 | CGM-1X | none | HTM-2 | Resin-7a | ETM-2 | +711 | +115 | 9.5 | Poor |
| B-16 | CGM-1X | none | HTM-3 | Resin-7a | ETM-2 | +699 | +113 | 9.3 | Poor |
| B-17 | CGM-1X | none | HTM-1 | Resin-8a | ETM-2 | +706 | +116 | 11.2 | Poor |
| B-18 | CGM-1X | none | HTM-2 | Resin-8a | ETM-2 | +707 | +119 | 11.8 | Poor |
| B-19 | CGM-1X | none | HTM-3 | Resin-8a | ETM-2 | +695 | +113 | 12.5 | Poor |

The photosensitive layer of each of the multi-layer photosensitive members (A-1) to (A-12) and the single-layer photosensitive members (A-13) to (A-36) contained the charge generating material, the compound (1) used as the hole transport material, and the resin (2) used as the binder resin. Therefore, as shown in Tables 1, 3, and 4, the multi-layer photosensitive members (A-1) to (A-12) and the single-layer photosensitive members (A-13) to (A-36) had small abrasion loss, and were excellent in the abrasion resistance.

The photosensitive layer of each of the multi-layer photosensitive members (A-1) to (A-8), (A-10), and (A-11), and the single-layer photosensitive members (A-13) to (A-20), (A-22), (A-23), and (A-25) to (A-36) contained the resin (2) as the binder resin. In particular, each of these photosensitive members contained the resin (2) represented by general formula (2) in which $R_{23}$ represents a hydrogen atom, or an alkyl group having a carbon number of at least 1 and no greater than 4, $R_{24}$ represents a hydrogen atom, $R_{25}$ represents an alkyl group having a carbon number of at least 1 and no greater than 4, $p+q=1.00$, and $0.40 \leq p \leq 0.60$. Therefore, as shown in Tables 1, 3, and 4, the multi-layer photosensitive members (A-1) to (A-8), (A-10), and (A-11), and the single-layer photosensitive members (A-13) to (A-20), (A-22), (A-23), and (A-25) to (A-36) had particularly small abrasion loss, and were particularly excellent in the abrasion resistance.

The photosensitive layer of each of the multi-layer photosensitive members (A-1) to (A-5) and (A-8) to (A-12) contained the compound (1) as the hole transport material. In particular, each of these photosensitive members contained the compound (1) represented by general formula (1) in which a diphenylamino phenyl ethenyl group having $R_3$ and $R_4$ is positioned in the para-position of a phenyl group to which the diphenylamino phenyl ethenyl group is bonded. Therefore, as shown in Table 1, the multi-layer photosensitive members (A-1) to (A-5) and (A-8) to (A-12) were excellent not only in the abrasion resistance but also in the electric characteristic.

The photosensitive layer of each of the single-layer photosensitive members (A-25) to (A-36) contained titanyl phthalocyanine as the charge generating material, and further contained an n-type pigment. Therefore, as shown in Table 4, the single-layer photosensitive members (A-25) to (A-36) were excellent not only in the abrasion resistance but also in the electric characteristic.

On the other hand, the photosensitive layer of each of the multi-layer photosensitive members (B-1) to (B-10) did not contain the resin (2) as the binder resin. The photosensitive layer of each of the multi-layer photosensitive members (B-11) to (B-13) did not contain the compound (1) as the hole transport material. Each of the single-layer photosensitive members (B-14) to (B-19) did not contain the resin (2) as the binder resin. Therefore, as shown in Tables 2 and 5, the multi-layer photosensitive members (B-1) to (B-13) and the single-layer photosensitive members (B-14) to (B-19) had large abrasion loss and were inferior in the abrasion resistance.

What is claimed is:

1. An electrophotographic photosensitive member comprising a conductive substrate and a photosensitive layer, wherein the photosensitive layer is a single-layer type photosensitive layer, the single-layer type photosensitive layer contains at least a charge generating material, a hole transport material, a binder resin, and an electron transport material, the hole transport material is a compound represented by the following chemical formula (HTM-1), the binder resin is a resin represented by the following general formula (2), and the electron transport material is a compound represented by the following chemical formula (ETM-2) or (ETM-8), (HTM-1)

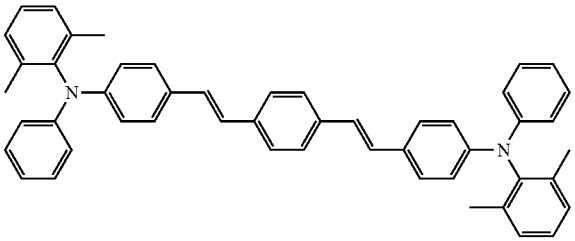

(ETM-2)

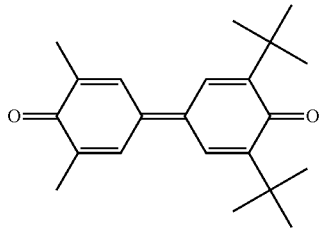

(ETM-8)

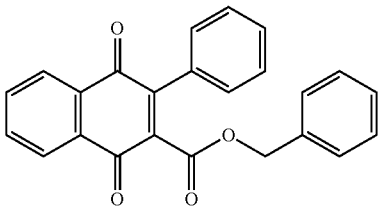

(2)

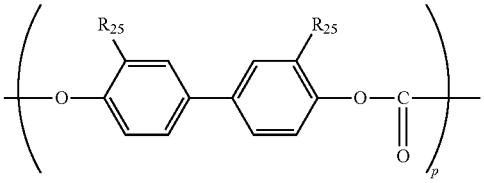

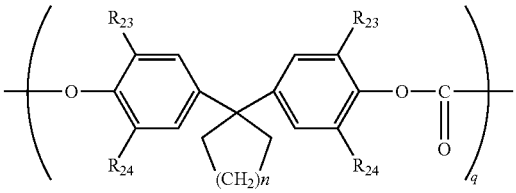

where in general formula (2), $R_{23}$ represents a hydrogen atom, or an alkyl group having a carbon number of at least 1 and no greater than 4, $R_{24}$ represents a hydrogen atom, $R_{25}$ represents an alkyl group having a carbon number of at least 1 and no greater than 4, $p+q=1.00$, $0.40 \leq p \leq 0.60$, and n represents 2 or 3.

2. The electrophotographic photosensitive member according to claim 1, wherein the resin represented by general formula (2) is a resin represented by the following chemical formula (Resin-2).

(Resin-2)

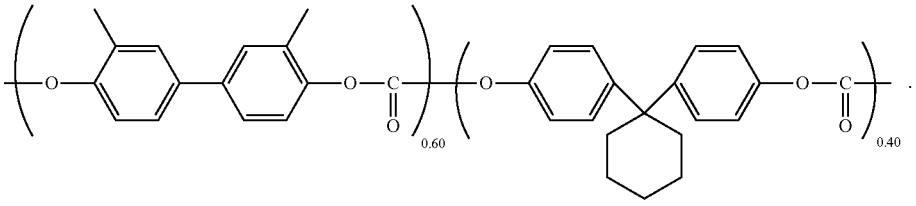

3. The electrophotographic photosensitive member according to claim 1, wherein the charge generating material is titanyl phthalocyanine, and the single-layer type photosensitive layer further contains an n-type pigment.

4. The electrophotographic photosensitive member according to claim 3, wherein the n-type pigment is an azo pigment.

5. A process cartridge comprising the electrophotographic photosensitive member according to claim 1.

6. An image forming apparatus comprising:

an image bearing member;

a charging section configured to charge a surface of the image bearing member;

a light exposure section configured to form an electrostatic latent image on the surface of the image bearing member;

a developing section configured to develop the electrostatic latent image into a toner image; and a transfer section configured to transfer the toner image from the image bearing member to a transfer target, wherein the image bearing member is the electrophotographic photosensitive member according to claim 1.

7. The electrophotographic photosensitive member according to claim 1, wherein the resin represented by general formula (2) is a resin represented by the following chemical formula (Resin-1).

(Resin-1)

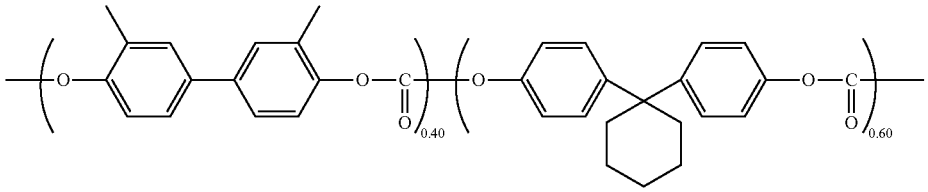

8. The electrophotographic photosensitive member according to claim 1, wherein the resin represented by general formula (2) is a resin represented by the following chemical formula (Resin-1), the electron transport material is a compound represented by chemical formula (ETM-2), the single-layer type photosensitive layer further contains an n-type pigment, and the n-type pigment is a compound represented by the following chemical formula (A1).

(Resin-1)

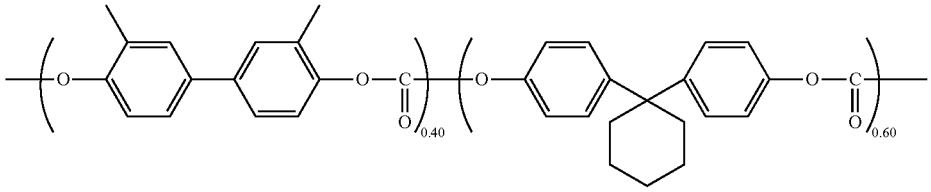

(A1)

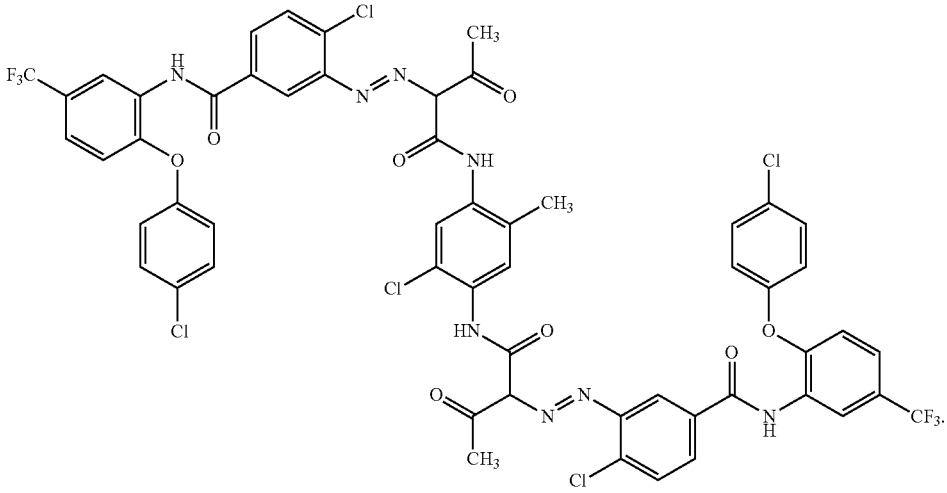

9. The electrophotographic photosensitive member according to claim 1, wherein the resin represented by general formula (2) is a resin represented by the following chemical formula (Resin-1), the electron transport material is a compound represented by chemical formula (ETM-8), the single-layer type photosensitive layer further contains an n-type pigment, and the n-type pigment is a compound represented by the following chemical formula (A1).

(Resin-1)

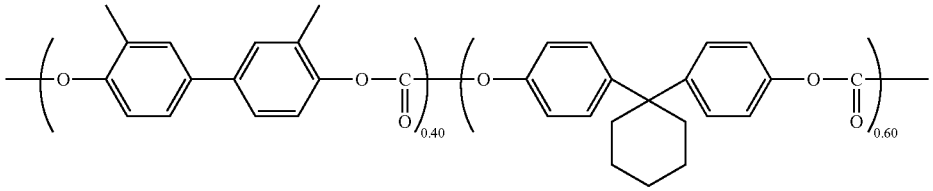

(A1)

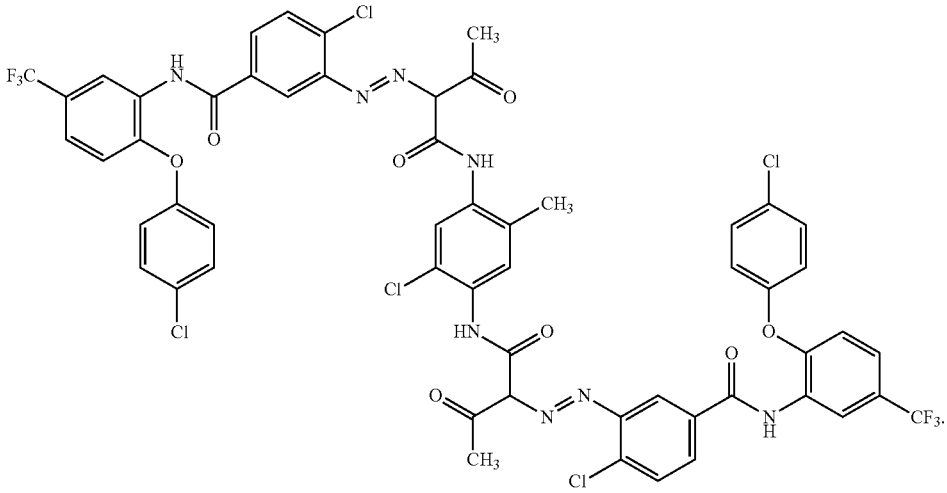

* * * * *